United States Patent [19]

Abe

[11] Patent Number: 5,068,170

[45] Date of Patent: Nov. 26, 1991

[54] METHOD FOR PROCESSING SILVER HALIDE COLOR PHOTOGRAPHIC MATERIALS

[75] Inventor: Akira Abe, Kanagawa, Japan

[73] Assignee: Fuji Photo Film Co., Ltd., Kanagawa, Japan

[21] Appl. No.: 564,518

[22] Filed: Aug. 9, 1990

[30] Foreign Application Priority Data

Aug. 11, 1989 [JP] Japan ..... 1-206990

[51] Int. Cl.[5] ..... G03C 7/31; G03C 7/42

[52] U.S. Cl. ..... 430/393; 430/399; 430/430; 430/431; 430/455; 430/460; 430/461; 430/462

[58] Field of Search ..... 430/393, 399, 430, 431, 430/455, 460, 461, 462

[56] References Cited

U.S. PATENT DOCUMENTS

| | | | |
|---|---|---|---|
| 3,997,348 | 12/1976 | Shimamura et al. | 430/393 |
| 4,842,994 | 6/1989 | Sakanoue et al. | 430/543 |
| 4,914,009 | 4/1990 | Ueda et al. | 430/430 |
| 4,963,474 | 10/1990 | Fujita et al. | 430/393 |

FOREIGN PATENT DOCUMENTS

| | | |
|---|---|---|
| A0326030 | 4/1985 | European Pat. Off. . |
| A0173540 | 3/1986 | European Pat. Off. . |
| A0293719 | 12/1988 | European Pat. Off. . |
| 1392163 | 4/1975 | United Kingdom . |

OTHER PUBLICATIONS

GP 6404, 6, vol. 13, No. 203 (P-870) (3551), May 15, 1989, Appln. No. 62-181883.

*Primary Examiner*—Hoa Van Le

*Attorney, Agent, or Firm*—Sughrue, Mion, Zinn, Macpeak & Seas

[57] ABSTRACT

A method for processing an imagewise exposed silver halide color photographic material for photography which comprises the steps of:

color-developing a silver halide color photographic material with a color developing solution, processing said developed silver halide color photographic material with a bleaching solution, and then processing said bleached silver halide color photographic material with a processing solution having a fixing ability, wherein the replenishment rate of said color developing solution is 600 ml or less per $m^2$ of the photographic material; said bleaching solution contains a bleaching agent having an oxidation reduction potential of 150 mV or more and further an organic acid having a pKa of from 2 to 5.0, provided that an aminopolycarboxylic acid or a salt thereof and an iron complex salt of the aminopolycarboxylic acid are excluded, in an amount of 1.2 mol or more per liter of the bleaching solution; said bleaching solution has a pH value of 3.0 to 5.0; and the total time for processing said photographic material with the processing solution having a fixing ability is in the range of 30 seconds to 2 minutes;

or a method for processing an imagewise exposed silver halide color photographic material for photography which comprises the steps of:

color-developing a silver halide color photographic material with a color developing solution and immediately processing said developed silver halide color photographic material with a blixing solution, wherein the replenishment rate of said color developing solution is 600 ml or less per $m^2$ of the photographic material; said blixing solution contains a bleaching agent having an oxidation reduction potential of 150 mV or more; said blixing solution has a pH value of 5.0 to 6.5; and the total time for processing said photographic material with the blixing solution is in the range of 30 seconds to 2 minutes.

13 Claims, No Drawings

METHOD FOR PROCESSING SILVER HALIDE COLOR PHOTOGRAPHIC MATERIALS

FIELD OF THE INVENTION

The present invention relates to a method for processing a silver halide color photographic material. More particularly, the present invention relates to an improved method for processing a silver halide color photographic material for photography which enables the formation of excellent images even if the replenishment rate of a color developing solution is reduced.

BACKGROUND OF THE INVENTION

In recent years, the study of methods for the reduction of the amount of waste water from processing has been under way out of the necessity to inhibit water contamination and to reduce processing cost. These methods have been put into practical use in certain processing steps. In particular, with respect to color development, which causes much contamination, various approaches have been proposed. For example, the approach described in JP-A No. 54-37731, JP-A No. 56-1048, JP-A No. 56-1049, JP-A No. 56-27142, JP-A No. 56-33644, and JP-A No. 56-149036 (the term "JP-A" as used herein refers to a "published unexamined Japanese patent application"), and JP-B No. 61-10199 (the term "JP-B" as used herein refers to an "examined Japanese patent publication") comprises the utilization of electrodialysis. In addition, various color developer regeneration methods have been proposed. For example, JP-B-55-1571 and JP-A No. 58-14831 propose the use of activated carbon to regenerate the color developer. JP-A No. 52-105820 proposes the use of ion exchange membranes. JP-A No. 55-144240, JP-A No. 57-146249 and JP-A No. 61-95352 propose the use of ion exchange resins.

However, these methods are disadvantageous in that they all need an analysis and proper control of the composition of the color developer, requiring a high degree of control and expensive apparatus. As a result, these methods have been put into practical use only in certain large scale processing laboratories.

In another method which does not utilize the regeneration of color developer, the composition of the replenisher of the color developer (hereinafter referred to as "color developer replenisher") is properly adjusted so that the replenishment rate can be reduced. In this method, the adjustment of the composition of the color developer replenisher is accomplished by, e.g., concentrating consumable components such as the color developing agent and preservative so that the required amount of necessary components can be supplied even if the replenishment rate is reduced. When a silver halide color photographic material is processed, halogen ions are released into the color developer. In processing at a reduced replenishment rate, the bromide ion concentration in the color developer increases, inhibiting development. Accordingly, in order to inhibit the increase in the bromide ion concentration, the bromide concentration in the replenisher is predetermined at a value lower than normal.

This low replenishment processing is advantageous in that it leads to inhibition of water pollution and reduction in processing cost. This processing is also advantageous in that it can be effected without careful analysis of the composition of the processing solution.

On the other hand, in recent years, with the spread of the small service system called "minilaboratories" (i.e., small-sized laboratories), it has been keenly demanded to reduce the time required for processing so as to rapidly serve of customers.

Particularly, a reduction in desilvering time that accounts for the majority of the conventional processing time has been strongly desired.

However, this processing was found disadvantageous in that when the color developer replenishment rate is drastically reduced, the delay in fixing becomes more remarkable at the desilvering step following the color development step, particularly the delay in rapid fixing in which the fixing time for processing a silver halide color photographic material with a processing solution having a fixing ability is reduced to 2 minutes or less become more remarkable at the desilvering step following the color development step, and the discoloration of yellow dye occurs with time after processing. The color developer replenishment rate depends on the type of light-sensitive material to be processed. For color negative films for photography, the replenishment rate is normally in the range of about 1,200 ml per $m^2$ of the light-sensitive material. These color negative films suffer from the above troubles when the replenishment rate is reduced to 600 ml or less per $m^2$ of the material.

Thus, the above mentioned low replenishment processing is advantageous in its simplicity but disadvantageous in that the drastic reduction in the replenishment rate is limited (e.g., 600 ml/$m^2$ for color negative films for photographing).

SUMMARY OF THE INVENTION

An object of the present invention is to provide a method for processing a silver halide color photographic material which is not susceptible to delay in fixing and discoloration of yellow dye with time even if the color developer replenishment rate is drastically reduced or the silver halide color photographic material is rapidly fixed.

The above and other objects of the present invention will become more apparent from the following detailed description and examples.

These objects of the present invention are accomplished by a method for processing an imagewise exposed silver halide color photographic material for photography which comprises the steps of:

color-developing a silver halide color photographic material with a color developing solution, processing said developed silver halide color photographic material with a bleaching solution, and then processing said bleached silver halide color photographic material with a processing solution having a fixing ability, wherein the replenishment rate of said color developing solution is 600 ml or less per $m^2$ of the photographic material; said bleaching solution contains a bleaching agent having an oxidation reduction potential of 150 mV or more and further an organic acid having a pKa of from 2 to 5.0, provided that an aminopolycarboxylic acid or a salt thereof and an iron complex salt of the aminopolycarboxylic acid are excluded, in an amount of 1.2 mol or more per liter of the bleaching solution; said bleaching solution has a pH value of 3.0 to 5.0; and the total time for processing said photographic material with the processing solution having a fixing ability is in the range of 30 seconds to 2 minutes;

or a method for processing an imagewise exposed silver halide color photographic material for photography which comprises the steps of:

color-developing a silver halide color photographic material with a color developing solution and immediately processing said developed silver halide color photographic material with a blixing solution, wherein the replenishment rate of said color developing solution is 600 ml or less per $m^2$ of the photographic material; said blixing solution contains a bleaching agent having an oxidation reduction potential of 150 mV or more; said blixing solution has a pH value of 5.0 to 6.5; and the total time for processing said photographic material with the blixing solution is in the range of 30 seconds to 2 minutes.

It was also found that these objects of the present invention are more remarkably accomplished by preferably controlling the dry thickness of the constituent layer in the silver halide color photographic material to 20.0 $\mu$m or less.

Further, it was also found that these objects of the present invention are more remarkably accomplished by controlling the pH of fixing solution following the processing solution having a bleaching ability to from 7 to 8.0.

DETAILED DESCRIPTION OF THE INVENTION

In general, in order to keep the content of necessary components constant while reducing the replenishment rate, it is necessary to supply a highly active concentrated solution as a replenisher. Furthermore, since the replenishment rate (overflow rate) is reduced regardless of the production of a reaction product depending on the processed amount of the light-sensitive material (i.e., the photographic material), the concentration of the reaction product accumulated in the processing solution and the elutes from the light-sensitive material become higher. Accordingly, if the color developer replenishment rate is reduced, the concentration of oxidation products of the color developing agent, and elutes from the light-sensitive material such as mercapto compounds, various antifoggants, various coupler releasing groups, sensitizing dyes and antihalation dyes in the color developer become higher. The present invention is based on the hypothesis that the delay in fixing and discoloration of yellow dye over time caused by the reduction of the replenishment rate is attributable to the increase in the amount of these components left in the light-sensitive material.

In particular, even if the color developer replenishment rate is reduced to 600 ml/$m^2$ or less, when a bleaching agent having a relatively low oxidation reduction potential which has been commonly used in the art (e.g., ferric complex of ethylenediaminetetraacetic acid having an oxidation reduction potential of 110 mV) is replaced by a bleaching agent having a high oxidation reduction potential in the subsequent desilvering step, intermediate oxidation products of the color developing agent which are believed to discolor dyes, and various antifoggants, development inhibitors and sensitizing agents which are believed to be adsorbed by silver causing delay in fixing are oxidized or desorbed therefrom. As a result, there is little effect on yellow dye fastness and fixability even if they are left in the light-sensitive material.

In the present method for processing a silver halide color photographic material (hereinafter optionally referred to as "light-sensitive material"), the light-sensitive material which has been imagewise exposed to light is subjected to color development and then to processing with a processing solution having a bleaching ability.

In the present invention, the replenishment rate of the color developing solution is in the range of 600 ml or less. In order to make the objects of the present invention more remarkable, the replenishment rate of the color developing solution is preferably from 100 to 500 ml, more preferably from 100 to 400 ml, particularly from 100 to 300 ml.

The color developing agent to be incorporated in the color developing solution and its replenisher is an aromatic primary amine compound. Examples of such an aromatic primary amine compound include known compounds widely used in various color photographic processings. Preferred examples of color developing agents which can be used in the present invention include N,N-dialkyl-p-phenylenediamine color developing agents such as (1) 4-(N-ethyl-N-$\beta$-hydroxyethylamino)-2-methylaniline sulfate,
(2) 4-(N-ethyl-N-$\beta$-methanesulfonamidoethylamino)-2-methylaniline sulfate,
(3) 4-(N-ethyl-N-$\beta$-methoxyethylamino)-2-methylaniline-p-toluene sulfonate,
(4) 4-(N,N-diethylamino)-2-methyl aniline hydrochloride,
(5) 4-(N-ethyl-N-dodecylamino)-2-methylaniline sulfate, and
(6) N,N-diethyl-p-phenylenediamine hydrochloride.

Such a compound is incorporated in the color developing solution in an amount of generally 0.005 to 0.05 mol/liter, preferably 0.01 to 0.03 mol/liter, particularly preferably 0.013 to 0.02 mol/liter. Such a compound is preferably incorporated in the replenisher of the color developing solution at a higher concentration than the above mentioned value. The specific concentration value depends on the predetermined replenishment rate. The concentration of the color developing agent in the replenisher of the color developing solution is normally 1.05 to 2.0 times, preferably 1.2 to 1.8 times, that of the color developing solution (running solution or mother liquor).

These color developing agents can be used singly or in combination depending on the purpose. Preferred examples of combinations of these color developing agents include combinations of (1}and (2), (1) and (3), and (2) and (3).

In the present invention, the bromide ion concentration of the color developing solution is preferably in the range of 0.005 to 0.02 mol/liter. To this end, the bromide content of the replenisher is preferably kept at 0.005 mol/liter or less. In general, the more the replenishment rate is reduced, the lower should be predetermined the bromide content of the replenisher. In particular, the bromide content of the present replenisher is preferably 0.03 mol/liter or less, particularly preferably 0 mol/liter.

Examples of such a bromide include potassium bromide, sodium bromide, lithium bromide, and hydrobromic acid.

The color developing solution and its replenisher may include a preservative such as hydroxylamine, diethylhydroxylamine, triethanolamine compounds described in West German Patent No. (OLS) 2,622,950, hydrazines described in JP-A No. 63-146041, sulfite, and hydrogensulfite.

For the purpose of softening hard water or hiding metal, various chelating agents can be incorporated in the color developing solution and its replenisher. In particular, the present color developing solution and its replenisher preferably comprise at least one of compounds represented by formulae (II) and (III):

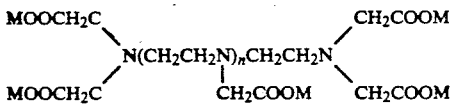
(II)

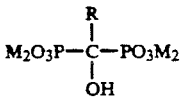
(III)

wherein n represents an integer 1 or 2; R represents a lower alkyl group (preferably having from 1 to 3 carbon atoms); and M represents a hydrogen atom, an alkali metal atom or ammonium. The M's may be the same or different. atom or ammonium. The Particularly preferred among the lower alkyl groups represented by R are a methyl group and an ethyl group. M is preferably a hydrogen atom or a sodium atom. These compounds serve to inhibit the change in gradation and fog density in the processing of a color light-sensitive material comprising a compound of formula (I) at a low replenishment rate.

Accordingly, the present invention can be more effectively embodied by incorporating at least one of compounds represented by formulae (II) and (III) in the color developing solution and its replenisher.

In particular, two or more of compounds represented by formulae (II) and (III) are preferably used in combination.

Specific examples of the compounds represented by formula (II) or (III) will be set forth below.

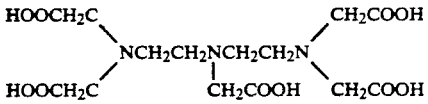
(II-1)

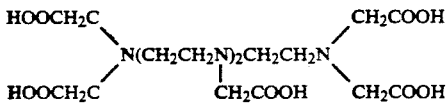
(II-2)

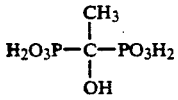
(III-1)

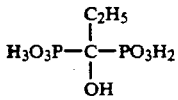
(III-2)

The compound represented by formula (II) is incorporated in the color developing solution and its replenisher in an amount of generally 0.0005 to 0.02 mol/liter, preferably 0.001 to 0.01 mol/liter. The compound represented by formula (III) is incorporated in the color developing solution and its replenisher in an amount of generally 0.002 to 0.1 mol/liter, preferably 0.005 to 0.05 mol/liter.

If the compound represented by formula (II) and the compound represented by formula (III) are used in combination, the amount of the compound represented by formula (II) is predetermined generally 2 to 20 times, preferably 3 to 15 times, more preferably 3 to 10 times, by molecular ratio that of the compound represented by formula (III).

Particularly preferred among these specific examples is the combination of (II-1) and (III-1).

The color developing solution to be used in the present invention can comprise additives other than the above mentioned compounds. Examples of such additives include pH buffers such as a carbonate, borate and phosphate of an alkali metal; development inhibitors or antifoggants such as iodide, benzimidazoles, benzothiazoles and mercapto compounds; organic solvents such as diethylene glycol; development accelerators such as benzyl alcohol, polyethylene glycol, quaternary ammonium amines and thiocyanate; nucleating agents such as sodium borohydride auxiliary developing agents such as 1-phenyl-3-pyrazolidone; and a thickening agent. In addition to the compounds represented by formulae (II) and (III), various chelating agents such as ethylenediaminetetraacetic acid, nitrilotriacetic acid, cyclohexanediaminetetraacetic acid, iminodiacetic acid, hydroxyethyliminodiacetic acid, and organic phosphonic acids described in *Research Disclosure*, No. 18170 (May, 1979) can be used singly or in combination.

In the present invention, the color developing solution and its replenisher normally have a pH value of generally 9 or more, preferably 9.5 to 12, particularly 9.5 to 11.0. In this range, the pH value of the replenisher of the color developing solution is preferably predetermined to be about 0.05 to 0.5 higher than that of the color developing solution.

Color development is normally effected at a temperature of 30° to 45° C. In order to accomplish processing at a drastically reduced replenishment rate, color development is preferably effected at a higher temperature. In the present invention, color development is preferably effected at a temperature of 35° to 45° C., particularly 38° to 42° C.

The present invention can be effected in either an automatic developing machine or in a manual process, but preferably in an automatic developing machine. In the processing using an automatic developing machine, one or more color developing solution tanks can be used. In a multistage forward flow replenishment process in which the replenisher is supplied to the first of a plurality of color developing tanks and then flows forward, the replenishment rate can be further reduced. The area of the developing solution kept in contact with air in the tanks is preferably as small as possible. In particular, the effect of the present invention can be further attained by employing a covering means such as a floating cover, liquid seal having a high boiling point and a lower specific gravity than the developing solution and a tank having a narrow opening portion as described in JP-A No. 63-216050.

In order to further improve the effect of the present invention, water is preferably replenished to offset the change in concentration of the developing solution due to evaporation. The water replenisher is preferably deionized water obtained by ion exchanging or distillating water or subjecting water to reverse osmosis.

The preparation of the color developing solution and its replenisher can be accomplished by sequentially dissolving the above mentioned chemicals in a predetermined amount of water. The water is preferably the above mentioned deionized water.

In the present invention, the light-sensitive material which has been color developed is then processed with a processing solution having a bleaching ability. The term "processing solution having a bleaching ability" as used herein means a so-called bleaching solution or a blixing solution which has a bleaching ability and a fixing ability.

Typical examples of the desilvering processes using a bleaching solution, blixing solution or fixing solution in the present invention include:

(1) Bleaching→Fixing
(2) Bleaching→Blixing
(3) Bleaching→Washing→Fixing
(4) Rinse→Bleaching→Fixing
(5) Bleaching→Blixing→Fixing
(6) Washing→Blixing Particularly preferred among these processes are processes (1), (2) and (5). The process (2) is further disclosed in JP-A No. 61-75352.

In the present invention, at least one processing solution having a bleaching ability (preferably bleaching solution) can contain a bleaching agent having an oxidation reduction potential of 150 mV of more. Accordingly, if there are two or more processing solutions having a bleaching ability, the second processing solution having a bleaching ability (e.g., blixing solution) may contain a known bleaching agent such as a ferric complex of ethylenediaminetetraacetic acid, a ferric complex of diethylenetriaminepentaacetic acid and a ferric complex of trans-1,2-cyclohexanediaminetetraacetic acid. The second processing solution may contain any of these known bleaching agents.

In the present invention, the bleaching agent to be incorporated as the oxidizing agent in the processing solution having a bleaching ability has an oxidation reduction potential of 150 mV or more, preferably 180 mV or more, more preferably 200 mV or more, particularly 230 mV or more. The upper limit of the oxidation reduction potential is preferably 280 mV.

The oxidation reduction potential of the above mentioned bleaching agent can be defined by the value determined by the method in *Transactions of the Faraday Society*, Vol. 55, 1959, pp. 1312 and 1313.

In the present invention, the oxidation reduction potential is determined at a pH value of 6.0 by the above cited method.

It had been expected that a bleaching agent having an oxidation reduction potential of 150 mV or more has a sufficient oxidizing ability and thus enables a rapid bleaching. However, it was unexpectedly found that such a bleaching agent can eliminate the delay in fixing and discoloration of yellow dye over time caused by reduction of the replenishment rate of the color developing solution.

Examples of such a bleaching agent include inorganic compounds such as red prussiate of potash, ferric chloride, ferric bichromate, ferric persulfate and ferric bromate, and organic compounds such as ferric complex of aminopolycarboxylate. In the present invention, a ferric complex of aminopolycarboxylate is preferably used in the light of environmental protection, safety of handling and inhibition of corrosion of metal.

Specific examples of ferric complex of aminopolycarboxylate which can be used in the present invention and their oxidation reduction potential as determined by the above cited method will be set forth below, but the present invention should not be construed as being limited thereto.

| Compound No. | Oxidation Reduction Potential (mV vs NHE, pH = 6) |
|---|---|
| 1. Ferric complex of N-(2-acetamido)iminodiacetic acid | 180 |
| 2. Ferric complex of methyliminodiacetic acid | 200 |
| 3. Ferric complex of iminodiacetic acid | 210 |
| 4. Ferric complex of 1,4-diaminobutanetetraacetic acid | 230 |
| 5. Ferric complex of diethylenethioetherdiaminetetraacetic acid | 230 |
| 6. Ferric complex of glycol ether diaminetetraacetic acid | 240 |
| 7. Ferric complex of 1,3-diaminopropanetetraacetic acid | 250 |

Particularly preferred among these complexes are Compound No. 7 (ferric complex of 1,3-diaminopropanetetraacetic acid) (hereinafter referred to as "1,3-PDTA. Fe(III).

Such a ferric complex of aminopolycarboxylic acid is used generally in the form of a sodium, potassium or ammonium salt, preferably in the form of ammonium salt which can provide the fastest bleaching.

Ferric complex of ethylenediaminetetraacetic acid (EDTA·Fe(III)), which is widely used in the art, has an oxidation reduction potential of 110 mV. Ferric complex of diethylenetriaminepentaacetic acid and ferric trans-1,2-cyclohexanediaminetetraacetic acid have an oxidation reduction potential of 80 mV. Therefore, these complexes are excluded from those which can be used in the present invention.

The amount of the bleaching agent to be incorporated in the bleaching solution to be used in the present invention is preferably in the range of generally 0.10 mol or more, more preferably 0.15 mol or more, particularly 0.25 mol or more, per liter of bleaching solution to expedite processing and the effect of the present invention.

However, if an excessively high concentration bleaching solution is used, it lowers the bleaching reaction or the effect of the present invention. Therefore, the upper limit of the concentration of the bleaching agent is preferably about 0.7 mol/liter.

The amount of the bleaching agent to be incorporated in the blixing solution is in the range of generally 0.01 to 0.5 mol, preferably 0.015 to 0.3 mol, particularly 0.02 to 0.2 mol, per liter of blixing solution.

Ferric complex of aminopolycarboxylic acid, which can be preferably used in the present invention, can be preferably incorporated in the above mentioned range.

In the present invention, the above mentioned bleaching agents can be used singly or in combination. If two or more bleaching agents are used in combination, the total content of these bleaching agents can be in the above mentioned range.

In the present invention, in addition to the bleaching agent having an oxidation reduction potential of 150 mV or more, a bleaching agent having an oxidation reduction potential of less than 150 mV may be used.

The amount of such a bleaching agent to be used is preferably in the range of about 0.5 mol per mol of the bleaching agent having an oxidation reduction potential of 150 mV or more.

Examples of such a bleaching agent to be used in combination with ferric complex of aminopolycarboxylic acid having an oxidation reduction potential of 150 mV or more include ferric complexes of ethylenediaminetetraacetic acid, diethylenetriaminepentaacetic acid, and cyclohexanediaminetetraacetic acid.

If ferric complex of aminopolycarboxylic acid is used for the solution having a bleaching ability, it can be incorporated in the form of the above mentioned complex. Alternatively, aminopolycarboxylic acid and ferric salt (e.g., ferric sulfate, ferric chloride, ferric nitrate, ferric ammonium sulfate, ferric phosphate), which are complex forming compounds, can be added to the bleaching solution so that they can form a complex therein.

If the latter process is used, aminopolycarboxylic acid can be incorporated in slight excess of the amount required to form a complex with ferric ion, preferably 0.01 to 10% of the stoichiometric amount.

The present bleaching solution containing a bleaching agent having an oxidation reduction potential of 150 mV or more has a pH value of 3.0 to 5.0, preferably 3.0 to 4.5.

If the pH value falls below the above mentioned range, it deteriorates the solubility of the bleaching solution and its replenisher, causing precipitation at a low temperature, though attaining some effects in the reduction of bleach fogging and the expedition of processing. On the contrary, if the pH value exceeds the above mentioned range, it causes a remarkable increase in bleach fogging.

The present blixing solution containing a bleaching agent having an oxidation reduction potential of 150 mV or more has a pH value of 5.0 to 6.5, preferably 5.2 to 6.2, more preferably 5.5 to 6.0.

In the present invention, a known acid can be used to adjust the pH value at the above mentioned range.

As such an acid there can be preferably used an acid having a pKa value of 2 to 5. In the present invention, pKa is represented by the logarithm of the reciprocal of the acid dissociation constant as determined at an ionic strength of 0.1 mol/liter and a temperature of 25° C.

In the present invention, the bleaching solution containing an acid with a pKa value of 2.0 to 5.0 in an amount of 1.2 mol/liter or more is used at the desilvering process. However, aminopolycarboxylic acid or salts thereof and iron complexes of aminopolycarboxylic acid are excluded from the group of such an acid.

Specific preferred examples of an organic acid with a pKa of 2.0 to 5.0 which can be used in the present invention include aliphatic monobasic acids such as formic acid, acetic acid, monochloric acid, monobromoacetic acid, glycolic acid, propionic acid, monochloropropionic acid, lactic acid, pyruvic acid, acrylic acid, butyric acid, isobutyric acid, pivalic acid, aminobutyric acid, valeric acid, and isovaleric acid; amino acid compounds such as asparagine, alanine, arginine, ethionine, glycine, glutamine, cystein, serine, methionine, and leucine; mono-substituted benzoic acid such as benzoic acid, chlorobenzoic acid and hydroxybenzoic acid; aromatic monobasic acid such as nicotinic acid; aliphatic dibasic acid such as oxalic acid, malonic acid, succinic acid, tartaric acid, malic acid, maleic acid, fumaric acid, oxalacetic acid, glutaric acid, and adipic acid; amino acid dibasic acids such as aspartic acid, glutamic acid, glutaric acid, cystine, and ascorbic acid; aromatic dibasic acids such as phthalic acid, and terephthalic acid; polybasic acids such as citric acid, and other various organic acids.

In the present invention, monobasic acids containing carboxyl groups are preferable among these organic acids. Particularly preferred among these monobasic acids are acetic acid and glycolic acid.

In the present invention, the total content of these acids is in the range of generally 1.2 mol or more, preferably 1.2 to 2.5 mol, more preferably 1.5 to 2.0 mol, per liter of the bleaching solution.

When the pH value of the solution having a bleaching ability is adjusted to the above mentioned range, the above mentioned acid and an alkaline agent (e.g., aqueous ammonia, KOH, NaOH) may be used in combination. Preferred among these alkaline agents is aqueous ammonia.

The present solution having a bleaching ability and its prebath can include various bleaching accelerators.

Examples of bleaching accelerators which can be used in the present invention include the compounds containing mercapto or disulfide groups described in U.S. Pat. No. 3,893,858, West German Patent No. 1,290,810, British Patent No. 1,138,842, JP-A No. 53-95630, and *Research Disclosure*, No. 17129 (July, 1978); thiazoline derivatives described in JP-A No. 50-140129; thiourea derivatives described in U.S. Pat. No. 3,706,561; iodides described in JP-A No. 58-16235; polyethylene oxides described in West German Patent No. 2,748,430; and polyamine compounds described in JP-B No. 45-8836. Particularly among these compounds are mercapto compounds described in British Patent No. 1,138,842.

The present solution having a bleaching ability can include a rehalogenating agent besides the above mentioned bleaching agent. Examples of such rehalogenating agents include bromides such as potassium bromide, sodium bromide and ammonium bromide, and chlorides such as potassium chloride, sodium chloride and ammonium chloride. The content of such a rehalogenating agent is in the range of generally 0.1 to 5 mol, preferably 0.5 to 3 mol, per liter of solution having a bleaching ability.

As the metal corrosion inhibitor, ammonium nitrate is preferable.

If the present solution having a bleaching ability is a blixing solution, it can comprise a compound which can be incorporated in a fixing solution, such as a fixing agent and a preservative, as described later.

In the present invention, if the replenishment process is used, the replenishment rate of the solution having a bleaching ability is in the range of 200 ml or less, preferably 10 to 140 ml, per $m^2$ of light-sensitive material.

Processing with a bleaching solution is effected over generally 120 seconds or less, preferably 60 seconds or less, more preferably 50 seconds or less. The present invention can be most effectively effected when the processing is performed in such a reduced period of time.

In the processing, the solution containing a ferric complex of aminopolycarboxylic acid and having a bleaching ability is preferably subjected to aeration so that the ferric complex of aminopolycarboxylic acid is oxidized.

In the present invention, if the light-sensitive material is bleached with a bleaching solution after color development, it is then normally processed with a processing solution having a fixing ability.

Specific examples of such a processing solution include fixing solution and blixing solution. Such a processing solution comprises a fixing agent. Immediately after color development, when the light-sensitive material is blixed, the material may be or may not be processed with the fixing solution.

Examples of such a fixing agent which can be used in the present invention include thiosulfates such as sodium thiosulfate, ammonium thiosulfate, ammonium sodium thiosulfate and potassium thiosulfate; thiocyanates such as sodium thiocyanate, ammonium thiocyanate and potassium thiocyanate; thiorea, and thioether.

Preferred among these fixing agents are thiosulfates, particularly ammonium thiosulfate. A thiosulfate and a thiocyanate are preferably used in combination depending on the type of the light-sensitive material. In this case, ammonium thiosulfate and ammonium thiocyanate are used in combination.

If a thiosulfate is used singly as a fixing agent, its content is in the range of generally 0.3 to 3 mol, preferably 0.5 to 2 mol, per liter of fixing or blixing solution. If a thiocyanate is used in combination with such a thiosulfate, its content is in the range of ½ to 2 times by molar ratio that of the thiosulfate.

Other examples of compounds other than thiocyanates which can be used in combination with thiosulfate (particularly ammonium thiosulfate) include thiourea, and thioether (e.g., 3,6-dithia-1,8-octanediol).

The content of these compounds is normally in the range of generally 0.01 to 0.1 mol, optionally 1 to 3 mol, per liter of fixing or blixing solution.

The fixing or blixing solution can include as a preservative a sulfite (e.g., sodium sulfite, potassium sulfite, ammonium sulfite), hydroxylamine, hydrazine, bisulfite addition product of aldehyde compound such as acetaldehyde sodium bisulfite, or the like. The fixing or blixing solution can further include various fluorescent brightening agents, anfifoaming agents or surface active agents, and organic solvents such as polyvinyl pyrrolidone and methanol. In particular, the fixing or blixing solution can preferably contain as a preservative a sulfinic acid compound described in JP-A No. 62-143048.

In the present invention, the fixing solution following the processing solution having a bleaching ability has a pH value of preferably from 5.0 to 9.0, more preferably from 7.0 to 8.0, most preferably from 7.2 to 7.8 and further most preferably from 7.4 to 7.6. When the fixing solution has a pH value of from 7.0 to 8.0, the effect of the present invention can be remarkably accomplished by using the processing solution having a bleaching ability which contains a bleaching agent having an oxidation reduction potential of 150 mV or more.

Usually, although the fixing speed is not depended upon a pH of the fixing solution, in the present invention, the fixing ability is more improved by selecting the above defined pH, and further the decoloration of yellow dye after processing is reduced by the selection of the above pH. Thus, the effect of the present invention can be remarkably accomplished by the selection of the above pH.

The pH buffering agent can be preferably used in the fixing solution in addition to ammonia of an alkali agent to maintain the pH of the fixing solution to the above ranges. For example, the pH buffering agents such as sulfite, carbonate, hydrogen carbonate, borate, phosphate and imidazole can be preferably added in an amount of from 0.15 to 0.3 mol per liter of the fixing solution.

The above effect of the present invention due to the pH can be more remarkably improved when the fixing time is shortened. That is, when the fixing time is less than 90 seconds, the above effect of the present invention can be extremely improved by adjusting the pH of the fixing solution to the above ranges.

If the blixing bath follows the present bleaching bath containing a bleaching agent having an oxidation reduction potential of 150 mV or more, a pH value of the fixing solution is preferably in the range of generally 5.0 to 8.5, more preferably 6.0 to 7.5.

If the blixing bath follows the fixing or bleaching bath in a replenishment process, its replenishment rate is preferably in the range of 300 to 3,000 ml, more preferably 300 to 1,000 ml, per $m^2$ of light-sensitive material.

The fixing and blixing solution preferably further comprise various aminopolycarboxylic acids or organic phosphonic acids for the purpose of stabilizing the solution.

In the present invention, the total time of the fixing or blixing process following the bleaching process or the time of blixing processing which is immediately carried out after the color development is preferably in the range of 30 seconds to 2 minutes, more preferably 105 seconds or less, particularly 90 seconds or less.

Processing with the bleaching, blixing or fixing solution is effected at a temperature of generally 25° to 50° C., preferably 35° to 45° C.

In the present desilvering process, stirring is effected as vigorously as possible to further accomplish the effects of the present invention.

In order to effect stirring more vigorously, many methods can be used. For example, a jet of a processing solution can be allowed to strike against the surface of an emulsion layer of a light-sensitive material as described in JP-A No. 62-183460 and JP-A No. 62-183461. In a method described in JP-A No. 62-183461, a rotary means can be used to improve the agitating effect. Furthermore, the light-sensitive material can be moved with its emulsion surface kept in contact with a wiper blade provided in the processing solution so that turbulence occurs on the emulsion surface to improve the agitating effect. Moreover, the total circulated flow rate of the processing solution can be increased to improve the agitating effect. Such an agitation acceleration process can be effectively accomplished with the bleaching solution, blixing solution or fixing solution. The acceleration of agitation accelerates the supply of a bleaching agent or fixing agent to the emulsion film, resulting in an increase in the desilvering speed.

The above mentioned agitation acceleration process can be more effectively accomplished with a bleaching accelerator. In such agitation acceleration, the bleaching accelerating effect can be remarkably improved or the inhibition of fixing by the bleaching accelerator can be eliminated.

In the present invention, the blixing solution to be supplied at the beginning of the processing (mother liquor) can be prepared by dissolving the above mentioned compounds to be incorporated in the blixing solution, in water. Alternatively, a bleaching solution and a fixing solution which have been separately prepared can be mixed in a proper proportion.

Furthermore, the bleaching bath, fixing bath or other processing baths may consist of one or more tanks (e.g., 2 to 4 tanks, preferably in a countercurrent process).

In the present invention, the color development process is preferably followed immediately by a processing with a processing solution having a bleaching ability. In such a process, the effects of the present invention can be remarkably accomplished.

The present processing method consists of the above mentioned processing steps such as color development, bleaching, blixing and fixing. The blixing or fixing step is normally followed by washing and stabilizing. The bath having a fixing ability can be simply followed by stabilizing rather than a substantial washing.

The washing water to be used in the washing step can optionally comprise known additives. Examples of such known additives include hard water softeners such as inorganic phosphoric acid, aminopolycarboxylic acid and organic phosphoric acid; germicides or antimolds for inhibiting the propagation of various bacteria and algae (e.g., isothiazolone, organic chlorine germicide, benzotriazole); and surface active agents for inhibiting dry load and unevenness. Furthermore, compounds described in L. E. West "Water Quality Criteria", *Phot. Sci. and Eng.*, Vol. 9, No. 6, pages 344 to 359 (1965) can be used.

As a stabilizing solution to be used in the stabilizing process, a processing solution for stabilizing dye images is appropriate. Example of such a processing solution include a solution having a pH value of 3 to 6 and a buffering ability and a solution containing an aldehyde (e.g., formaldehyde). Such a stabilizing solution can optionally comprise an ammonium compound, a metallic compound such as Bi and Al, a fluorescent brightening agent, a chelating agent (e.g., 1-hydroxyethylidene-1,1-diphosphonic acid), a germicide, an antimold, a film hardener, a surface active agent, alkanolamine or the like.

The washing and stabilizing process is preferably effected in a multistage countercurrent process. In the multistage countercurrent process, the number of stages is preferably in the range of 2 to 4. The replenishment rate per unit area is preferably 1 to 50 times, more preferably 2 to 30 times, and most preferably from 2 to 15 times, the amount of the processing solution carried over from the prebath.

As water to be used in the washing or stabilizing process there can be preferably tap water or water obtained by deionizing water with an ion exchanging resin or the like so that Ca and Mg concentration is reduced to 5 mg/liter or less or by sterilizing water with halogen or by an ultraviolet germicidal lamp.

The overflow solution from the washing step or stabilizing step can be allowed to flow into the prebath having a fixing ability to reduce the amount of waste water.

The present process can be normally effected by means of an automatic developing machine. The automatic developing machine to be used in the present process preferably comprises the light-sensitive material carrying means described in JP-A No. 60-191257, JP-A No. 60-191258 and JP-A No. 60-191259.

As described in the above cited JP-A No. 60-191257, such a carrying means enables a remarkable reduction in the amount of the processing solution carried over from preceding bath to the subsequent bath, effectively inhibiting the deterioration in the properties of the processing solution. In particular, this effect leads to the reduction in the processing time and replenishment rate at each process.

The effects of the present invention can be remarkably accomplished when the processing time after color development (excluding drying time) is short, specifically 4 minutes or less, preferably 3 minutes and 30 seconds or less, particularly 3 minutes or less. In this case, the difference between the prior art processing method and the present method can be more remarkable.

The present color -photographic light-sensitive material for photographing can comprise at least one blue-sensitive layer, at least one green-sensitive layer and at least one red-sensitive layer on a support. The number of silver halide emulsion layers and light-insensitive layers and the order of arrangement of these layers are not specifically limited. In a typical embodiment, the present silver halide photographic material comprises light-sensitive layers consisting of a plurality of silver halide emulsion layers having substantially the same color sensitivity and different light sensitivities on a support. The light-sensitive layers are unit light-sensitive layers having a color sensitivity to any of blue, green and red lights. In the multilayer silver halide color photographic materials, these unit light-sensitive layers are normally arranged in the order of red-sensitive layer, green-sensitive layer and blue-sensitive layer as viewed from the support. However, the order of arrangement can be optionally reversed. Alternatively, two unit light-sensitive layers having the same color sensitivity can be arranged with a unit light-sensitive layer having a different color sensitivity interposed therebetween.

Light-insensitive layers such as various interlayers may be provided between these silver halide light-sensitive layers or between the uppermost layer and lowermost layer.

The interlayers can comprise couplers, DIR compounds or the like as described in JP-A No. 61-43748, JP-A No. 59-113438, JP-A No. 59-113440, JP-A No. 61-20037 and JP-A No. 61-20038. These interlayers may further comprise a color stain inhibitor, ultraviolet absorbent, stain inhibitor or the like as commonly used.

The plurality of silver halide emulsion layers constituting each unit light-sensitive layer can be preferably in a two-layer structure, i.e., high speed emulsion layer and slow speed emulsion layer, as described in West German Patent No. 1,121,470 and British Patent No. 923,045. In general, these layers are preferably arranged in such an order that the light sensitivity becomes lower in a direction toward the support. Furthermore, a light-insensitive layer can be provided between these silver halide emulsion layers. As described in JP-A No. 57-112751, JP-A No. 62-200350, JP-A No. 62-206541 and JP-A No. 62-206543, a slow speed emulsion layer can be provided remote from the support while a high speed emulsion layer can be provided nearer to the support.

In an embodiment of such an arrangement, a slow speed blue-sensitive layer (BL), a high speed blue-sensitive layer (BH), a high speed green-sensitive layer (GH), a slow speed green-sensitive layer (GL), a high speed red-sensitive layer (RH), and a slow speed red-sensitive layer (RL) can be arranged in this order remote from the support. In another embodiment, BH, BL, GL, GH, RH, and RL can be arranged in this order remote from the support. In a further embodiment, BH, BL, GH, GL, RL, and RH can be arranged in this order remote from the support.

As described in JP-B No. 55-34932, a blue-sensitive layer, GH, RH, GL, and RL can be arranged in this order remote from the support. Alternatively, as described in JP-A No. 56-25738 and JP-A No. 62-63936, a blue-sensitive layer, GL, RL, GH, and RH can be arranged in this order remote from the support.

As described in JP-B No. 49-15495, a layer arrangement can be used such that the uppermost layer is a silver halide emulsion layer having the highest sensitivity, the middle layer is a silver halide emulsion layer having a lower sensitivity than that of the uppermost layer, and the lowermost layer is a silver halide emulsion layer having a lower sensitivity than that of the middle layer. In such a layer arrangement, the light sensitivity becomes lower in a direction toward the support. Even if the layer structure comprises three layers having different light sensitivities, a middle speed emulsion layer, a high speed emulsion layer and a slow speed emulsion layer can be arranged in this order remote from the support in a color-sensitive layer.

As described above, various layer structures and arrangements can be selected depending on the purpose of light-sensitive material.

Any of these layer arrangements can be used in the present color light-sensitive material. In the present invention, the total dry thickness of all constituent layers (photographic constituent layers) of the color light-sensitive layer except support, subbing layer of support and backing layer is preferably 20.0 μm or less, more preferably 18.0 μm or less, to accomplish the objects of the present invention.

This is true perhaps because the color developing agent and the various coating components taken into the color light-sensitive material and these layers during processing can be more easily washed away during color development or subsequent steps as the film thickness becomes thinner.

The lower limit of the film thickness is preferably determined so that the properties of the light-sensitive material cannot be drastically impaired. The lower limit of the total dried film thickness of the constituent layers except the support and subbing layer of support is 12.0 μm. The lower limit of the total dry thickness of the constituent layers provided between the light-sensitive layer provided nearest to the support and the support is preferably 1.0 μm.

Either the light-sensitive layer or the light-insensitive layer can be thinned.

In the present invention, the film thickness of the multilayer color light-sensitive material is determined in the following manner.

The light-sensitive material sample to be measured is allowed to stand at a temperature of 25° C. and a relative humidity of 50% over 7 days after being prepared. The total thickness of the light-sensitive material sample is then measured. The coating layer is then removed from the support. The thickness of the support is then measured. The difference between the two thickness values is the thickness of the coating layer in the light-sensitive material. The measurement of the thickness can be accomplished by means of a film thickness meter using a contact type piezoelectric conversion element (e.g., K-402B stand.; manufactured by Anritsu Electric Co., Ltd.). The removal of the coating layer from the support can be accomplished with an aqueous solution of sodium hypochlorite.

A section of the above mentioned light-sensitive material sample is photographed under a scanning electron microscope at a magnification of preferably 3,000 or more. The total thickness of the layers on the support and the thickness of each layer are measured on the photograph. Thus, the thickness of each layer can be calculated relative to the total thickness of the constituent layers determined previously.

The percentage swelling of the present light-sensitive material ((equilibrated swollen film thickness in water at 25° C.−total dried film thickness at 25° C. and 55% RH)/total dry film thickness at 25° C. and 55% RH)×100) is preferably in the range of 50 to 200%, more preferably 70 to 150%. If the percentage of swelling deviates from the above mentioned range, the remaining amount of the color developing agent increases, adversely affecting the picture quality such as the photographic properties, the desilvering properties and the film properties such as film strength.

The present light-sensitive material preferably exhibits a swelling speed $T\frac{1}{2}$ of 15 seconds or less, more preferably 9 seconds or less. The swelling speed $T\frac{1}{2}$ can be determined by any method known in the art. For example, the measurement can be accomplished by means of a swellometer of the type as described in A. Green et al., *Photographic Science and Engineering*, Vol. 19, No. 2, pp. 124 to 129. The swelling speed $T\frac{1}{2}$ can be defined as the time taken until the film thickness reaches half the saturated film thickness. The saturated film thickness is defined as 90% of the maximum swollen thickness which has reached when the sample is processed with a color developing solution at a temperature of 30° C. over 3 minutes and 15 seconds.

A suitable silver halide to be incorporated in the photographic emulsion layer of the present color light-sensitive material for photographing is silver bromoiodide, silver chloroiodide or silver bromochloroiodide containing silver iodide in an amount of from 0.1 to 30 mol% or less. Particularly suitable is silver bromoiodide containing silver iodide in an amount of about 2 mol% to about 25 mol%.

Silver halide grains in the photographic emulsions may be so-called regular grains having a regular crystal form, such as cube, octahedron and tetradecahedron, or those having an irregular crystal form such as sphere and tabular, those having a crystal defect such as twinning plane, or those having a combination of these crystal forms.

The silver halide grains may be either fine grains of about 0.2 μm or less in diameter or giant grains having a projected area diameter of about 10 μm or more, and the emulsion may be either a monodisperse emulsion having a narrow size distribution or a polydisperse emulsion having a broad size distribution.

The preparation of the silver halide photographic emulsion which can be used in the present invention can be accomplished by any suitable method described in *Research Disclosure*, No. 17643 (December, 1978), pp. 22 and 23, "I. Emulsion Preparation and Types", and ibid., No. 18716 (November, 1979), p. 648, P. Glafkides, *Chimie et Physique Photographique*, Paul Montel (1967), G. F. Duffin, *Photographic Emulsion Chemistry*, Focal Press (1966), or V. L. Zelikman et al., *Making and Coating Photographic Emulsion*, Focal Press (1964).

Furthermore, the monodisperse emulsions described in U.S. Pat. Nos. 3,574,628 and 3,655,394 and British Patent No. 1,413,748 can be preferably used in the present invention.

Tabular grains having an aspect ratio of about 5 or more can be used in the present invention. The preparation of such tabular grains can be easily accomplished by any suitable method described in Gutoff, *Photographic Science and Engineering*, Vol. 14, pp. 248 to 257

(1970), U.S. Pat. Nos. 4,434,226, 4,414,310, 4,433,048, and 4,439,520 or British Patent No. 2,112,157.

The individual silver halide crystals may have either a homogeneous structure or a heterogeneous structure composed of a core and an outer shell differing in halogen composition, or may have a layered structure. Furthermore, the grains may be epitaxially fused thereto a silver halide having a different halogen composition or a compound other than silver halide, e.g., silver thiocyanate, lead oxide, etc.

Mixtures of grains having various crystal forms may also be used.

The silver halide emulsion to be used in the present invention is normally subjected to physical ripening, chemical ripening, and spectral sensitization. Additives to be used in these steps are described in *Research Disclosure*, Nos. 17643 and 18716 as tabulated below.

Known photographic additives which can be used in the present invention are also described in the above cited two references as shown in the table.

| Additives | RD 17643 | RD 18716 |
|---|---|---|
| 1. Chemical Sensitizers | Page 23 | Page 648, right column |
| 2. Sensitivity Increasing Agents | — | Page 648, right column |
| 3. Spectral Sensitizers and Supersensitizers | Pages 23-24 | Page 648, right column to page 649, right column |
| 4. Brightening Agents | Page 24 | — |
| 5. Antifoggants and Stabilizers | Pages 24-25 | Page 649, right column |
| 6. Light Absorbents, Filter Dyes, and Ultraviolet Absorbents | Pages 25-26 | Page 649, right column to page 650, left column |
| 7. Stain Inhibitors | Page 25, right column | Page 650, left to right columns |
| 8. Dye Image Stabilizers | Page 25 | — |
| 9. Hardening Agents | Page 26 | Page 651, left column |
| 10. Binders | Page 26 | Page 651, left column |
| 11. Plasticizers and Lubricants | Page 27 | Page 650, right column |
| 12. Coating Aids and Surface Active Agents | Pages 26-27 | Page 650, right column |
| 13. Antistatic Agents | Page 27 | Page 650, right column |

Various color couplers can be used in the present invention. Specific examples of the color couplers are described in the above cited *Research Disclosure*, No. 17643, VII-C to G.

Preferred yellow couplers include those described in U.S. Pat. Nos. 3,933,501, 4,022,620, 4,326,024, 4,401,752, 4,248,961, 3,973,968, 4,314,023 and 4,511,649, JP-B No. 58-10739, British Patent Nos. 1,425,020 and 1,476,760, and European Patent No. 249,473A.

Preferred magenta couplers include 5-pyrazolone compounds and pyrazoloazole compounds. Particularly preferred are those described in U.S. Pat. Nos. 4,310,619, 4,351,897, 3,061,432, 3,725,064, 4,500,630, 4,540,654, and 4,556,630, European Patent No. 73,636, JP-A No. 60-33552, JP-A No. 60-43659, JP-A No. 61-72238, JP-A No. 60-35730, JP-A No. 55-118034, and JP-A- No. 60-185951, *Research Disclosure*, No. 24220 (June, 1984), and Research Disclosure, No. 24230 (June, 1984), and WO (PCT) 88/04795.

Cyan couplers include naphthol and phenol couplers. Preferred are those described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011, 4,327,173, 3,446,622, 4,333,999, 4,753,871, 4,451,559, 4,427,767, 4,690,889, 4,254,212, and 4,296,199, West German Patent (DT-OS) No. 3,329,729, European Patent Nos. 121,365A and 249,453A, and JP-A No. 61-42658.

Colored couplers for correction of unnecessary absorption of the developed color preferably include those described in *Research Disclosure*, No. 17643, VII-G, U.S. Pat. Nos. 4,163,670, 4,004,929 and 4,138,258, JP-B No. 57-39413, and British Patent No. 1,146,368. Furthermore, couplers for correction of unnecessary absorptions of the developed color by a fluorescent dye released upon coupling described in U.S. Pat. No. 4,774,181 and couplers containing as a releasing group a dye precursor group capable of reacting with a developing agent to form a dye described in U.S. Pat. No. 4,777,120 can be preferably used.

Couplers which form a dye having moderate diffusibility preferably include those described in U.S. Pat. No. 4,366,237, British Patent No. 2,125,570, European Patent No. 96,570, and West German Patent (DT-OS) No. 3,234,533.

Typical examples of polymerized dye forming couplers are described in U.S. Pat. Nos. 3,451,820, 4,080,211, 4,367,282, 4,409,320, and 4,576,910 and British Patent No. 2,102,173.

Couplers capable of releasing a photographically useful residue upon coupling can also be used in the present invention. Preferred examples of DIR couplers which release a developing inhibitor are described in the patents cited in RD, No. 17643, VII-F, JP-A No. 57-151944, JP-A No. 57-154234, JP-A No. 60-184248, and JP-A No. 63-37346, and U.S. Pat. Nos. 4,248,962 and 4,782,012.

Couplers capable of imagewise releasing a nucleating agent or a developing accelerator at the time of development preferably include those described in British Patent Nos. 2,097,140 and 2,131,188, and JP-A No. 59-157638 and JP-A No. 59-170840.

In addition to the foregoing couplers, the photographic material according to the present invention can further comprise competing couplers described in U.S. Pat. No. 4,130,427; polyequivalent couplers described in U.S. Pat. Nos. 4,283,472, 4,338,393, and 4,310,618; DIR redox compounds or DIR coupler-releasing couplers or DIR coupler-releasing redox compounds described in JP-A No. 60-185950 and JP-A No. 62-24252; couplers capable of releasing a dye which restores to its original color after release described in European Patent No. 173,302A; couplers capable of releasing a bleach accelerator described in RD Nos. 11449 and 24241 and JP-A No. 61-201247; couplers capable of releasing a ligand as described in U.S. Pat. No. 4,553,477; couplers capable of releasing a leuco dye described in JP-A No. 63-75747; and couplers capable of releasing a fluorescent dye described in U.S. Pat. No. 4,774,181.

The incorporation of these couplers in the light-sensitive material can be accomplished by any suitable known dispersing method.

Examples of high boiling point solvents to be used in the oil-in-water dispersion process are described in U.S. Pat. No. 2,322,027. Specific examples of high boiling point organic solvents having a boiling point of 175° C. or higher at normal pressure which can be used in the water-in-oil dispersion process include phthalic esters (e.g., dibutyl phthalate, dicyclohexyl phthalate, di-2-ethylhexyl phthalate, decyl phthalate, bis(2,4-di-t-amylphenyl) phthalate, bis(2,4-di-t-amylphenyl) isophthalate, bis(1,1-diethylpropyl) phthalate), phosphoric or phosphonic esters (e.g., triphenyl phosphate, tricresyl phosphate, 2-ethylhexyldiphenyl phosphate, tricyclohexyl phosphate, tri-2-ethylhexyl phosphate, tridecyl phosphate, tributoxyethyl phosphate, trichloropropyl phosphate, di-2-ethylhexylphenyl phosphonate), benzoic esters (e.g., 2-ethylhexyl benzoate, dodecyl benzoate, 2-ethylhexyl-p-hydroxy benzoate), amides (e.g., N,N-diethyldodecanamide, N,N-diethyllaurylamide, N-tetradecylpyrrolidone), alcohols or phenols (e.g., isostearyl alcohol, 2,4-di-t-amylphenol), aliphatic carboxylic esters (e.g., bis(2-ethylhexyl) sebacate, dioctyl azelate, glycerol tributyrate, isostearyl lactate, trioctyl citrate), aniline derivatives (e.g., N,N-dibutyl-2-butoxy-5-tert-octylaniline), and hydrocarbons (e.g., paraffin, dodecylbenzene, diisopropylnaphthalene). As an auxiliary solvent there can be used an organic solvent having a boiling point of generally about 30° C. or higher, preferably about 50° C. to about 160° C. Typical examples of such an organic solvent include ethyl acetate, butyl acetate, ethyl propionate, methyl ethyl ketone, cyclohexanone, 2-ethoxyethyl acetate, and dimethylformamide.

The process and effects of latex dispersion method and specific examples of latexes to be used in dipping are described in U.S. Pat. No. 4,199,363, West German Patent Application Nos. (OLS) 2,541,274 and 2,541,230.

These couplers can be emulsion dispersed in an aqueous solution of hydrophilic colloid by impregnation in a loadable latex polymer (as described in U.S. Pat. No. 4,203,716) in the presence or absence of the above mentioned high boiling point organic solvent or in the form of a solution in a water-insoluble and organic solvent-soluble polymer.

The single polymers or copolymers described in International Publication No. WO88/00723, pp. 12 to 30, in particular acrylamide polymers, are preferably used to stabilize dye images.

The present invention is applicable to various type of color light-sensitive materials, particularly preferably to color negative films for common use or motion picture, and color reversal films for slide or television.

Suitable supports which can be used in the present invention are described in the above cited *Research Disclosure*, No. 17643, p. 28, and ibid., 18716, p. 647, right column to p. 648, left column.

The present invention will be further described in the following examples, but the present invention should not be construed as being limited thereto. Unless otherwise indicated, all parts, percents, ratios and the like are by weight.

EXAMPLE 1

A multilayer color light-sensitive material Sample 101 was prepared by coating various layers having the following compositions on an cellulose triacetate film support having a subbing layer.

Composition of Light-sensitive Layer

The components and their coated amounts are shown below. The coated amounts of silver halide and colloidal silver are calculated in terms of amount of silver. The coated amounts of couplers, additives and gelatin are represented in g/m$^2$. The coated amount of sensitizing dye is represented in molar number per mol of silver halide in the same layer.

| | |
|---|---|
| First Layer: Antihalation Layer: | |
| Black Colloidal Silver | 0.15 |
| Gelatin | 1.5 |
| ExM-8 | 0.08 |
| UV-1 | 0.03 |
| UV-2 | 0.06 |
| Solv-2 | 0.08 |
| UV-3 | 0.07 |
| Cpd-5 | $6 \times 10^{-4}$ |
| Second Layer: Intermediate Layer: | |
| Gelatin | 1.5 |
| UV-1 | 0.03 |
| UV-2 | 0.06 |
| UV-3 | 0.07 |
| ExF-1 | 0.004 |
| Solv-2 | 0.07 |
| Cpd-5 | $6 \times 10^{-4}$ |
| Third Layer: First Red-Sensitive Emulsion Layer: | |
| Silver Bromoiodide Emulsion (AgI content: 2 mol %; internal high AgI content type; diameter: 0.3 μm (as calculated in terms of a sphere); fluctuation coefficient of diameter: 29% (as calculated in terms of a sphere); mixture of normal crystal and twin; diameter/thickness ratio: 2.5) | 0.5 |
| Gelatin | 0.8 |
| ExS-1 | $1.0 \times 10^{-4}$ |
| ExS-2 | $3.0 \times 10^{-4}$ |
| ExS-3 | $1 \times 10^{-5}$ |
| ExC-3 | 0.22 |
| ExC-4 | 0.02 |
| ExY-15 | 0.01 |
| Cpd-5 | $3 \times 10^{-4}$ |
| Fourth Layer: Second Red-Sensitive Emulsion Layer: | |
| Silver Bromoiodide Emulsion (AgI content: 4 mol %; internal high AgI content type; diameter: 0.55 μm (as calculated in terms of a sphere); fluctuation coefficient of diameter: 20% (as calculated in terms of a sphere); mixture of normal crystal and twin; diameter/thickness ratio: 1) | 0.7 |
| Gelatin | 1.26 |
| ExS-1 | $1.0 \times 10^{-4}$ |
| ExS-2 | $3.0 \times 10^{-4}$ |
| ExS-3 | $1 \times 10^{-5}$ |
| ExC-3 | 0.33 |
| ExC-4 | 0.01 |
| ExY-16 | 0.01 |
| ExC-7 | 0.04 |
| ExC-2 | 0.08 |
| Solv-1 | 0.03 |
| Cpd-5 | $5 \times 10^{-4}$ |
| Fifth Layer: Third Red-Sensitive Emulsion Layer: | |
| Silver Bromoiodide Emulsion (AgI content: 10 mol %; internal high AgI content type; diameter: 0.7 μm (as calculated in terms of a sphere); fluctuation coefficient of diameter: 30% (as calculated in terms of a sphere); mixture of normal crystal and twin; diameter/thickness ratio: 2) | 0.7 |
| Gelatin | 0.8 |
| ExS-1 | $1.0 \times 10^{-4}$ |
| ExS-2 | $3.0 \times 10^{-4}$ |
| ExS-3 | $1 \times 10^{-5}$ |
| ExC-5 | 0.05 |
| ExC-6 | 0.06 |
| Solv-1 | 0.15 |
| Solv-2 | 0.08 |
| Cpd-5 | $3 \times 10^{-5}$ |
| Sixth Layer: Intermediate Layer: | |
| Gelatin | 1.0 |
| Cpd-5 | $4 \times 10^{-4}$ |
| Cpd-1 | 0.10 |
| Cpd-4 | 1.23 |
| Solv-1 | 0.05 |
| Cpd-3 | 0.25 |
| Seventh Layer: First Green-Sensitive Emulsion Layer: | |
| Silver Bromoiodide Emulsion (AgI content: 4 mol %; internal high AgI content type; diameter: 0.3 μm (as calculated | 0.30 |

-continued

| | |
|---|---|
| in terms of a sphere); fluctuation coefficient of diameter: 28% (as calculated in terms of a sphere); mixture of normal crystal and twin; diameter/thickness ratio: 2.5) | |
| Gelatin | 0.4 |
| ExS-4 | $5 \times 10^{-4}$ |
| ExS-6 | $0.3 \times 10^{-4}$ |
| ExS-5 | $2 \times 10^{-4}$ |
| ExM-9 | 0.2 |
| ExY-14 | 0.03 |
| ExM-8 | 0.03 |
| Solv-1 | 0.2 |
| Cpd-5 | $2 \times 10^{-4}$ |
| Eighth Layer: Second Green-Sensitive Emulsion Layer: | |
| Silver Bromoiodide Emulsion (AgI content: 4 mol %; internal high AgI content type; diameter: 0.55 μm (as calculated in terms of a sphere); fluctuation coefficient of diameter: 20% (as calculated in terms of a sphere); mixture of normal crystal and twin; diameter/thickness ratio: 4) | 0.6 |
| Gelatin | 0.8 |
| ExS-4 | $5 \times 10^{-4}$ |
| ExS-5 | $2 \times 10^{-4}$ |
| ExS-6 | $0.3 \times 10^{-4}$ |
| ExM-9 | 0.25 |
| ExM-8 | 0.03 |
| ExM-10 | 0.015 |
| ExY-14 | 0.04 |
| Solv-1 | 0.2 |
| Cpd-5 | $3 \times 10^{-4}$ |
| Ninth Layer: Third Green-Sensitive Emulsion Layer: | |
| Silver Bromoiodide Emulsion (AgI content: 10 mol %; internal high AgI content type; diameter: 0.7 μm (as calculated in terms of a sphere); fluctuation coefficient of diameter: 30% (as calculated in terms of a sphere); mixture of normal crystal and twin; diameter/thickness ratio: 2.0) | 0.85 |
| Gelatin | 1.0 |
| ExS-4 | $2.0 \times 10^{-4}$ |
| ExS-5 | $2.0 \times 10^{-4}$ |
| ExS-6 | $0.2 \times 10^{-4}$ |
| ExS-7 | $3.0 \times 10^{-4}$ |
| ExM-12 | 0.06 |
| ExM-13 | 0.02 |
| ExM-8 | 0.02 |
| Solv-1 | 0.20 |
| Solv-2 | 0.05 |
| Cpd-2 | 0.02 |
| Cpd-5 | $4 \times 10^{-4}$ |
| Tenth Layer: Yellow Filter Layer: | |
| Gelatin | 0.9 |
| Yellow Colloidal Silver | 0.05 |
| Cpd-1 | 0.2 |

-continued

| | |
|---|---|
| Solv-1 | 0.15 |
| Cpd-5 | $4 \times 10^{-4}$ |
| Eleventh Layer: First Blue-Sensitive Emulsion Layer: | |
| Silver Bromoiodide Emulsion (AgI content: 4 mol %; internal high AgI content type; diameter: 0.5 μm (as calculated in terms of a sphere); fluctuation coefficient of diameter: 15% (as calculated in terms of a sphere); octahedral grains) | 0.4 |
| Gelatin | 1.0 |
| ExS-8 | $2.0 \times 10^{-4}$ |
| ExY-16 | 0.9 |
| ExY-14 | 0.09 |
| Solv-1 | 0.3 |
| Cpd-2 | 0.02 |
| Cpd-5 | $4 \times 10^{-4}$ |
| Twelfth Layer: Second Blue-Sensitive Emulsion Layer: | |
| Silver Bromoiodide Emulsion (AgI content: 10 mol %; internal high AgI content type; diameter: 1.3 μm (as calculated in terms of a sphere); fluctuation coefficient of diameter: 25% (as calculated in terms of a sphere); mixture of normal crystal and twin; diameter/thickness ratio: 4.5) | 0.5 |
| Gelatin | 0.6 |
| ExS-8 | $1 \times 10^{-4}$ |
| ExY-16 | 0.12 |
| Solv-1 | 0.04 |
| Cpd-5 | $2 \times 10^{-4}$ |
| Thirteenth Layer: First Protective Layer: | |
| Fine Divided Silver Bromoiodide Grains (mean grain diameter: 0.07 μm; AgI content: 1 mol %) | 0.2 |
| Gelatin | 0.8 |
| UV-3 | 0.1 |
| UV-4 | 0.1 |
| UV-5 | 0.2 |
| Solv-3 | 0.04 |
| Cpd-5 | $3 \times 10^{-4}$ |
| Fourteenth Layer: Second Protective Layer: | |
| Gelatin | 0.9 |
| Polymethyl Methacrylate Grains (diameter: 1.5 μm) | 0.2 |
| Cpd-5 | $4 \times 10^{-4}$ |
| H-1 | 0.4 |

In addition to these components, a surface active agent was incorporated in each layer as a coating aid. Thus, Sample 101 was prepared. The dry thickness of the photographic constituent layers of this sample was 17.6 μm.

The compounds used in the present example are shown below.

UV-1

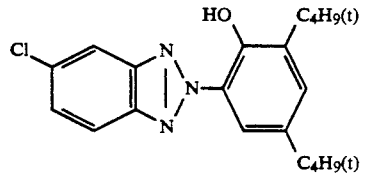

UV-2

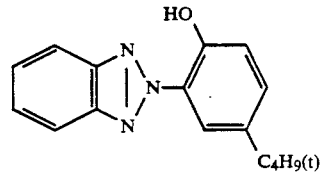

-continued
UV-3
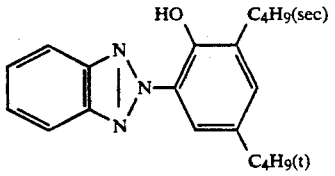
UV-4
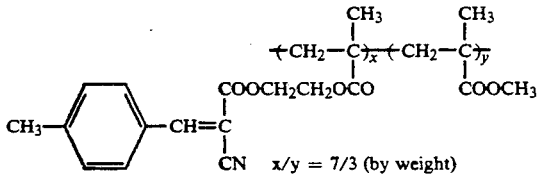
x/y = 7/3 (by weight)
UV-5
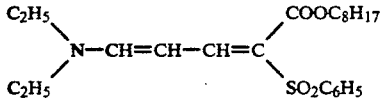
Solv-1: Tricresyl phosphate
Solv-2: Dibutyl phthalate
Solv-3: Bisphthalate(2-ethylhexyl)
ExM-8
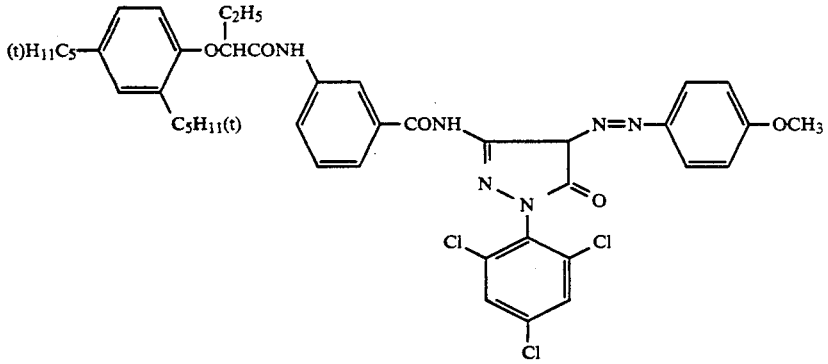
ExF-1:
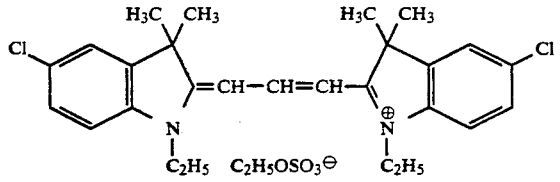
ExC-2:
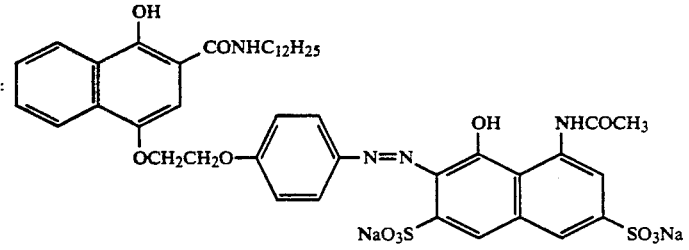
ExC-3:
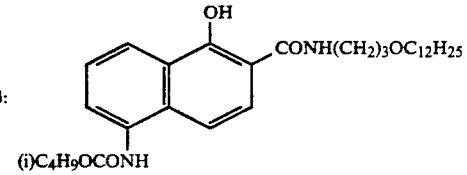

-continued
ExY-14:
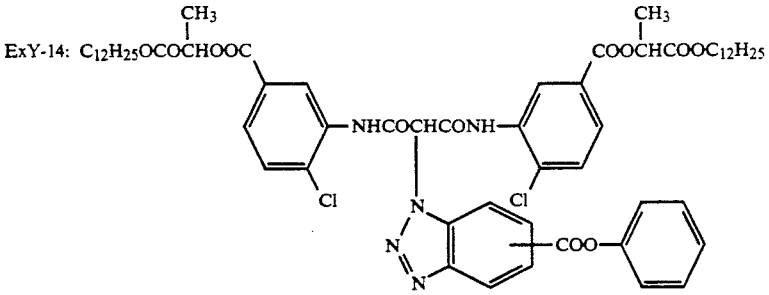
ExC-4:
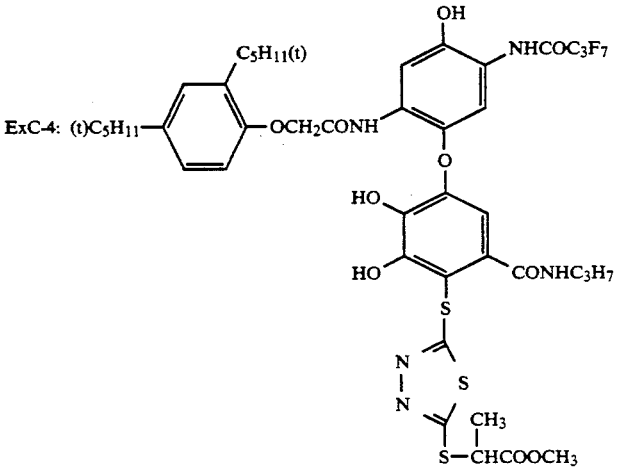
ExY-15:
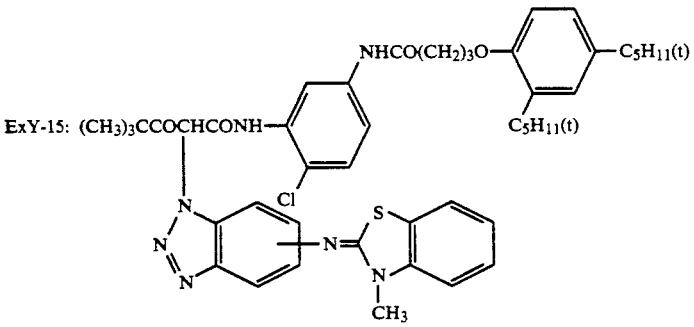
ExC-5:
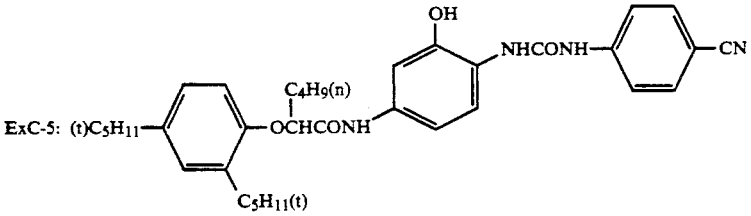
ExC-6:
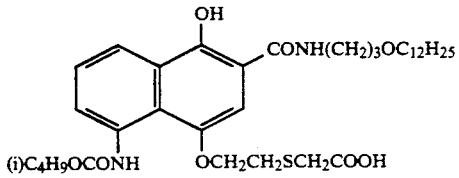

-continued
ExC-7:
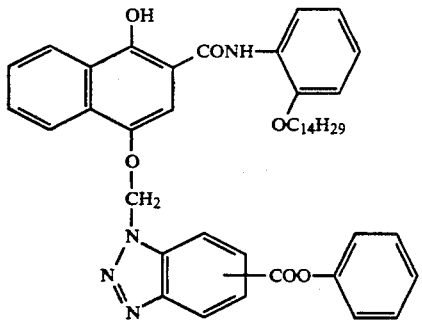
ExM-9:
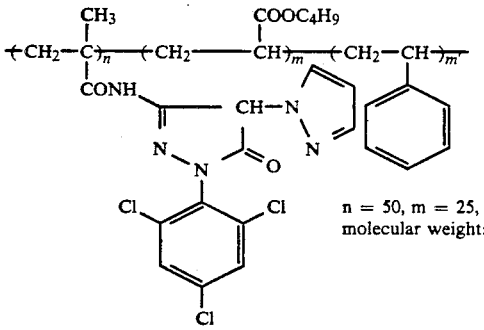
n = 50, m = 25, m' = 25
molecular weight: about 20,000
ExM-10:
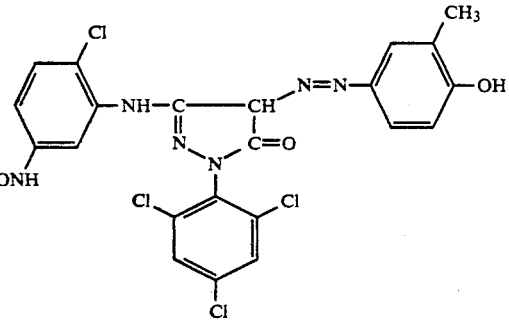
ExM-12:
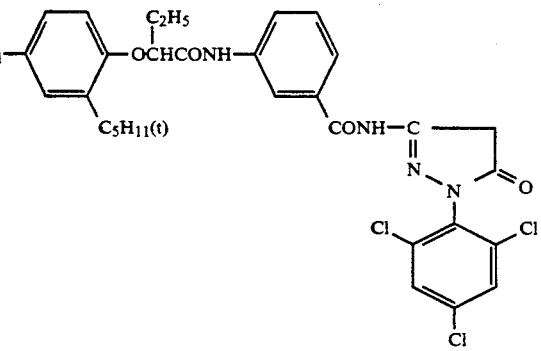

-continued
ExM-13:
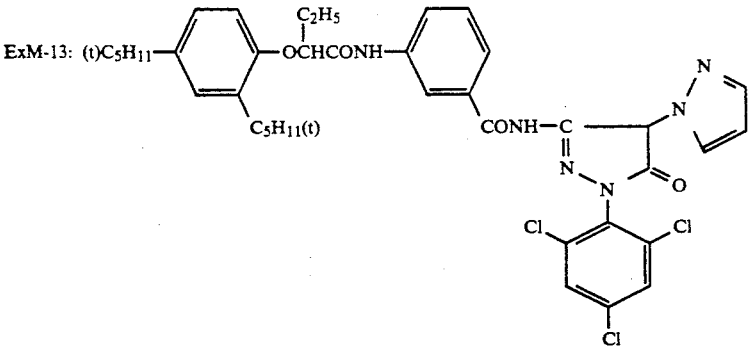
ExY-16:
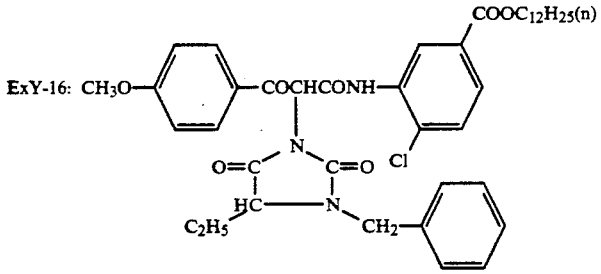
Cpd-1:
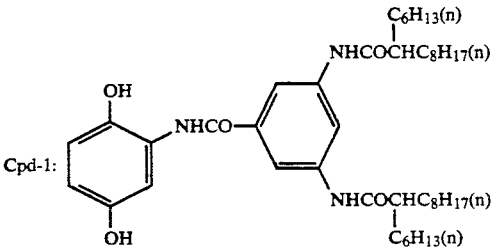
Cpd-2:
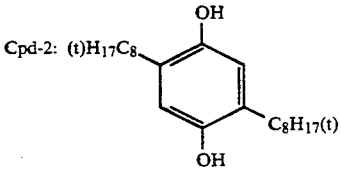
ExS-1:
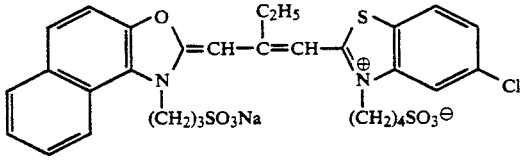
ExS-2:
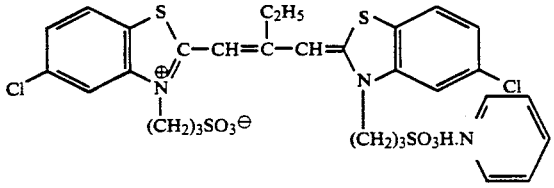
ExS-3:
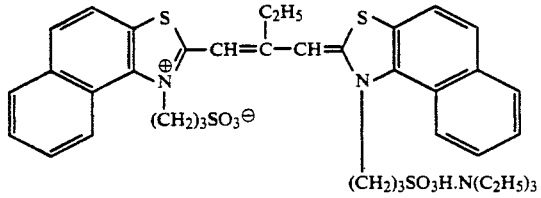

-continued

ExS-4:

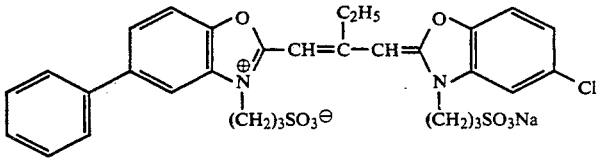

ExS-5:

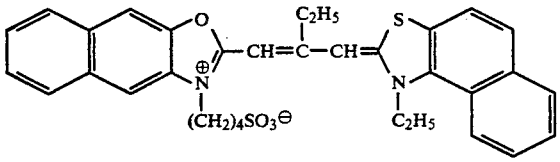

ExS-6:

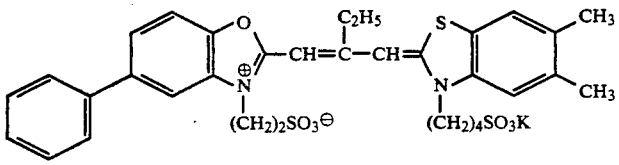

ExS-7:

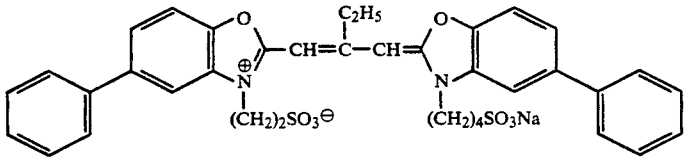

ExS-8:

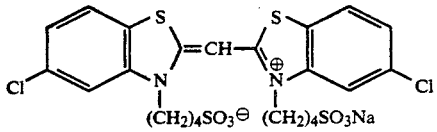

H-1:

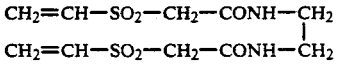

Cpd-3:

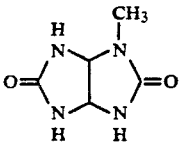

Cpd-4:

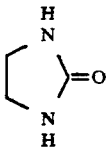

Cpd-5:

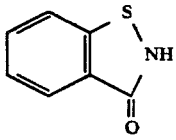

The color light-sensitive material (color negative film) Sample 101 thus prepared was cut into pieces with a width of 35 mm. The sample was then exposed to light in a camera. The sample was then subjected to Test Nos. 1 to 11. In these tests, the replenishment rate of a color developing solution and the bleaching agent to be incorporated in the bleaching solution were changed in the following processing steps in a small sized automatic developing machine as set forth in Table 2. The amount of the developing agent and potassium bromide corresponding to each replenishment rate of the color developing solution are shown in Table 1.

In each test, the light-sensitive material sample was processed until the replenishment rate of the color developing solution reached twice the volume of the color developing tank. Then, a light-sensitive material sample which had been wedgewise exposed to light at a color temperature of 4,800° K. and 20 CMS was similarly processed. In this respect, the amount of residual silver on the unexposed portions was measured by a fluorescent X-ray process to determine fixability of the sample. The initial yellow density of the sample was 2.70 as determined by means of an X Light 310 Type Photographic Densitometer. The sample was then allowed to stand at a temperature of 60° C. and a relative humidity of 80% over 2 weeks. The drop in the yellow density was then determined to evaluate discoloration.

| No. | Processing Time (sec) | Processing Temperature (°C.) | Replenishment Rate (ml) | Tank Volume (liter) |
|---|---|---|---|---|
| Color Development | 195 | 38.0 | As shown in Table 2 | 1 |
| Bleaching | 45 | 38.0 | 130 | 1 |
| Fixing | 90 | 38.0 | 800 | 1 |
| Washing (1) | 20 | 38.0 | Countercurrent process in which water flows backward ((2) → (1)) | 0.5 |
| Washing (2) | 20 | 38.0 | 500 | 0.5 |
| Stabilizing | 20 | 38.0 | 500 | 0.5 |
| Drying | 60 | 55.0 | — | — |

The replenishment rate above is represented per $m^2$ of light sensitive material.

The composition of the various processing solutions used in the present example were as follows:

| | Fresh Tank Solution | Replenisher |
|---|---|---|
| Color Developing Solution: | | |
| Diethylenetriaminepentaacetic Acid | 1.0 g | 1.0 g |
| 1-Hydroxyethylidene-1,1-diphosphonic Acid | 3.0 g | 3.2 g |
| Sodium Sulfite | 4.0 g | 4.9 g |
| Potassium Carbonate | 30.0 g | 30.0 g |
| Potassium Bromide | 1.4 g | As shown in Table 1 |
| Potassium Iodide | 1.5 mg | — |
| Hydroxylamine Sulfate | 2.4 g | 3.6 g |
| 4-(N-Ethyl-N-β-hydroxyethylamino)-2-methylaniline Sulfate | 4.5 g | As shown in Table 1 |
| Water to make | 1.0 liter | 1.0 liter |
| pH | 10.05 | 10.10 |
| Bleaching Solution: | | |
| Bleaching Agent (as set forth in Table 2) | 0.25 mol/l | 0.45 mol/l |
| Ammonium Bromide | 140.0 g | 180.0 g |
| Ammonium Nitrate | 30.0 g | 40.0 g |
| Acetic Acid (98 wt %, pKa: 4.6) | As shown in Table 2 | 1.2 times as large as the fresh tank solution |
| Glycolic Acid (pKa: 3.6) | As shown in Table 2 | 1.43 times as large as the fresh tank solution |
| Water to make | 1.0 liter | 1.0 liter |
| pH | 3.3 | 2.8 |
| Fixing Solution: | | |
| 1-Hydroxyethylidene-1,1-diphosphonic Acid | 1.0 g | 1.5 g |
| Ammonium Sulfite | 12.0 g | 20.0 g |
| Ammonium Thiosulfate | 1.5 mol/l | 1.7 mol/l |
| Water to make | 1.0 liter | 1.0 liter |
| pH | 6.7 | 6.4 |

Washing Water

Both the mother liquor and the replenisher were prepared by passing tap water through a mixed bed column packed with an H-type strongly acidic cation exchange resin ("Amberlite IR-120B", produced by Rohm & Haas Co.) and an OH-type anion exchange resin ("Amberlite IR-400", produced by the same company) to reduce calcium and magnesium ion concentrations each to 3 mg/liter or less, and then by adding to the resulting water 20 mg/liter of sodium dichloroisocyanurate and 0.15 g/liter of sodium sulfate.

The pH of the resulting solution was from 6.5 to 7.5.

| Stabilizing Solution: | Fresh Tank Solution | Replenisher |
|---|---|---|
| Triethanolamine | 2.0 g | 3.0 g |
| Formalin (37 wt %) | 2.0 ml | 3.0 ml |
| Polyoxyethylene-p-monononylphenylether (mean polymerization degree: 10%) | 0.3 g | 0.45 g |
| Disodium Ethylenediaminetetraacetate | 0.05 g | 0.08 g |
| Water to make | 1.0 liter | 1.0 liter |
| pH | 5.0–8.0 | 5.0–8.0 |

TABLE 1

| Replenishment Rate of Color Developer (per $m^2$ of light-sensitive material) (ml) | Concentration in Color Developer Replenisher | |
|---|---|---|
| | Developing Agent (g/liter) | Potassium Bromide (g/liter) |
| 1,200 | 5.3 | 0.7 |
| 600 | 6.3 | 0.3 |
| 300 | 7.8 | 0.0 |
| 150 | 10.5 | 0.0 |

TABLE 2

| Test No. | Color Developer Replenishment Rate (per $m^2$ of light-sensitive material) | Bleaching Agent* (oxidation reduction potential) | pH of Bleaching Solution | | Amount of Organic Acid in Bleaching Fresh Tank Solution | | Residual Silver Amount on Unexposed Portion ($\mu g/cm^2$) | Yellow Discoloration |
|---|---|---|---|---|---|---|---|---|
| | | | Fresh Tank Solution | Replenisher | Acetic Acid (mol) | Glycolic Acid (mol) | | |
| 1 (Comparison) | 1,200 | EDTA—Fe (110 mV) | 3.3 | 2.8 | 0.42 | 0.92 | 2.0 | −0.15 |
| 2 (Comparison) | 600 | EDTA—Fe (110 mV) | 3.3 | 2.8 | 0.42 | 0.92 | 7.2 | −0.29 |
| 3 (Comparison) | 300 | EDTA—Fe (110 mV) | 3.3 | 2.8 | 0.42 | 0.92 | 13.4 | −0.34 |

TABLE 2-continued

| Test No. | Color Developer Replenishment Rate (per $m^2$ of light-sensitive material) | Bleaching Agent* (oxidation reduction potential) | pH of Bleaching Solution | | Amount of Organic Acid in Bleaching Fresh Tank Solution | | Residual Silver Amount on Unexposed Portion ($\mu g/cm^2$) | Yellow Discoloration |
|---|---|---|---|---|---|---|---|---|
| | | | Fresh Tank Solution | Replenisher | Acetic Acid (mol) | Glycolic Acid (mol) | | |
| 4 (Invention) | 600 | PDTA—Fe (250 mV) | 3.3 | 2.8 | 0.42 | 0.92 | 2.4 | −0.16 |
| 5 (Invention) | 300 | PDTA—Fe (250 mV) | 3.3 | 2.8 | 0.42 | 0.92 | 2.7 | −0.18 |
| 6 (Invention) | 600 | BDTA—Fe (230 mV) | 3.3 | 2.8 | 0.42 | 0.92 | 3.2 | −0.17 |
| 7 (Invention) | 300 | BDTA—Fe (230 mV) | 3.3 | 2.8 | 0.42 | 0.92 | 3.3 | −0.20 |
| 8 (Invention) | 600 | MIDA—Fe (200 mV) | 3.3 | 2.8 | 0.42 | 0.92 | 4.5 | −0.22 |
| 9 (Invention) | 600 | GEDTA—Fe (240 mV) | 3.3 | 2.8 | 0.42 | 0.92 | 2.8 | −0.20 |
| 10 (Invention) | 300 | GEDTA—Fe (240 mV) | 3.3 | 2.8 | 0.42 | 0.92 | 3.0 | −0.24 |
| 11 (Invention) | 600 | AIDA—Fe (180 mV) | 3.3 | 2.8 | 0.42 | 0.92 | 5.5 | −0.22 |
| 12 (Comparison) | 600 | PDTA—Fe (250 mV) | 5.5 | 5.0 | 0.42 | 0.92 | 15.7 | −0.31 |
| 13 (Comparison) | 600 | PDTA—Fe (250 mV) | 3.3 | 2.8 | 0.20 | 0.40 | 10.8 | −0.33 |
| 14 (Invention) | 600 | PDTA—Fe (250 mV) | 4.5 | 4.0 | 0.42 | 0.92 | 3.4 | −0.20 |
| 15 (Invention) | 600 | PDTA—Fe (250 mV) | 4.0 | 3.4 | 0.42 | 0.92 | 2.8 | −0.18 |
| 16 (Invention) | 300 | PDTA—Fe (250 mV) | 4.5 | 4.0 | 0.42 | 0.92 | 3.9 | −0.22 |
| 17 (Comparison) | 600 | BDTA—Fe (230 mV) | 5.5 | 5.0 | 0.42 | 0.92 | 19.3 | −0.32 |
| 18 (Comparison) | 600 | BDTA—Fe (230 mV) | 3.3 | 2.8 | 0.20 | 0.40 | 16.6 | −0.30 |
| 19 (Invention) | 600 | BDTA—Fe (230 mV) | 4.5 | 4.0 | 0.42 | 0.92 | 4.0 | −0.20 |
| 20 (Invention) | 600 | BDTA—Fe (230 mV) | 4.0 | 3.4 | 0.42 | 0.92 | 3.7 | −0.19 |
| 21 (Invention) | 300 | PDTA—Fe (250 mV) | 3.3 | 2.8 | 0.7 | 1.0 | 2.2 | −0.16 |
| 22 (Invention) | 300 | BDTA—Fe (230 mV) | 3.3 | 2.8 | 0.7 | 1.0 | 3.0 | −0.18 |

*Bleaching agents are abbreviated as follows:
EDTA—Fe: Ferric complex of ethylenediaminetetraacetic acid
PDTA—Fe: Ferric complex of 1,3-diaminopropanetetraacetic acid
BDTA—Fe: Ferric complex of 1,4-diaminobutanetetraacetic acid
MIDA—Fe: Ferric complex of methyliminodiacetic acid
GEDTA—Fe: Ferric complex of glycoletherdiaminetetraacetic acid
AIDA—Fe: Ferric complex of N-(2-acetamido)iminodiacetic acid As is apparent from the results in Table 2, if EDTA-Fe, commonly used in the art, is incorporated in the bleaching solution, a sufficient fixability and dye fastness could be obtained when the replenishment rate of the color developer is 1,200 ml/$m^2$. However, these properties were remarkably deteriorated as the replenishment rate was reduced to 600 ml/$m^2$ and then to 300 ml/$m^2$. On the contrary, when the present bleaching agent having an oxidation reduction potential of 150 mV or more was used, even if the replenishment rate was 600 ml/$m^2$, the properties remained excellent as compared to that obtained with EDTA-Fe at a replenishment rate of 1,200 ml/$m^2$. Even if the replenishment rate is further reduced to 300 ml/$m^2$, these properties still remained excellent. This tendency becomes more remarkable when a bleaching agent having an oxidation reduction potential of 200 mV or higher or 230 mV or higher is used than when a bleaching agent having an oxidation reduction potential of 180 mV (AIDA-Fe) is used.

EXAMPLE 2

Samples 102, 103 and 104 were prepared in the same manner as Sample 101 except that the content of gelatin in the various layers was increased or decreased in the same proportions so that the thickness of the photographic constituent layers was controlled to 16.5 μm to 21 μm. These samples were exposed to light in the same manner as in Example 1. These samples were then subjected to Test Nos. 1 to 17. In these tests, the replenishment rate of the color developing solution and the bleaching agent to be incorporated in the blixing solution were changed in the following processing steps in a small sized automatic developing machine. These steps were effected in the same manner as in Example 1.

| No. | Processing Time (sec) | Processing Temperature (°C.) | Replenishment Rate (ml) | Tank Volume (liter) |
|---|---|---|---|---|
| Color Development | 180 | 38.0 | As set forth in Tables 1 and 3 | 1 |
| Blixing | As shown in Table 3 | 38.0 | 800 | 1 |
| Stabilizing (1) | 20 | 38.0 | Countercurrent process in which water flows backward ((3)→(2)→(1)) | 0.5 |
| Stabilizing (2) | 20 | 38.0 | | 0.5 |
| Stabilizing (3) | 20 | 38.0 | 400 | 0.5 |
| Drying | 60 | 60.0 | — | — |

*The replenishment rate is represented per $m^2$ of light-sensitive material.

Color Developing Solution

Same as in Example 1

| | Fresh Tank Solution | Replenisher |
|---|---|---|
| Blixing Solution: | | |
| Bleaching Agent (as shown in Table 3) | 0.2 mol/l | 0.24 mol/l |
| Ammonium Sulfite | 25 g/l | 30 g/l |
| 3-Mercapto-1,2,4-triazole | 0.3 g/l | 0.5 g/l |
| Ammonium Thiosulfate | 1.3 mol/l | 1.5 mol/l |
| pH (adjusted by an acetic acid) | As shown in Table 3 | As shown in Table 3 |

-continued

| | Fresh Tank Solution | Replenisher |
|---|---|---|
| Triethanolamine | 2.0 g | 3.0 g |
| Formalin (37 wt %) | 1.0 ml | 1.3 ml |
| Polyoxyethylene-p-monononyl-phenylether (mean polymerization degree: 10%) | 0.3 | 0.45 |
| Disodium Ethylenediaminetetra-acetate | 0.05 | 0.08 |
| Water to make | 1.0 l | 1.0 l |
| pH | 5.0–8.0 | 5.0–8.0 |

Stabilizing Solution:

TABLE 3

| Test No. | Sample No. | Thickness of Photographic Constituent Layers (μm) | Color Developer Replenishment Rate (per $m^2$ of light sensitive material) (ml) | Bleaching Agent (oxidation reduction potential) | Blixing Time | pH of Blixing Solution | Residual Silver Amount on Unexposed Portion (μg/$cm^2$) | Yellow Discoloration |
|---|---|---|---|---|---|---|---|---|
| 1 | 101 | 17.6 | 1,200 | EDTA—Fe (110 mV) | 2'00" | 5.8 (5.6) | 1.9 | −0.17 |
| 2 | " | " | 600 | EDTA—Fe (110 mV) | " | 5.8 (5.6) | 8.1 | −0.30 |
| 3 | " | " | 150 | EDTA—Fe (110 mV) | " | 5.8 (5.6) | 14.2 | −0.36 |
| 4 | " | " | 600 | PDTA—Fe (250 mV) | " | 5.8 (5.6) | 2.4 | −0.18 |
| 5 | " | " | 150 | PDTA—Fe (250 mV) | " | 5.8 (5.6) | 3.0 | −0.22 |
| 6 | 102 | 16.5 | 150 | PDTA—Fe (250 mV) | " | 5.8 (5.6) | 2.5 | −0.19 |
| 7 | 103 | 19.2 | 150 | PDTA—Fe (250 mV) | " | 5.8 (5.6) | 3.5 | −0.25 |
| 8 | 104 | 21.0 | 150 | PDTA—Fe (250 mV) | " | 5.8 (5.6) | 4.9 | −0.28 |
| 9 | 101 | 17.6 | 150 | BDTA—Fe (230 mV) | " | 5.8 (5.6) | 3.9 | −0.26 |
| 10 | " | " | 150 | MIDA—Fe (230 mV) | " | 5.8 (5.6) | 5.0 | −0.28 |
| 11 | 101 | 17.6 | 600 | PDTA | 2'00" | 6.7 (6.5) | 7.7 | −0.31 |
| 12 | " | " | 600 | " | " | 6.5 (6.3) | 2.7 | −0.20 |
| 13 | " | " | 600 | " | " | 5.5 (5.0) | 1.7 | −0.15 |
| 14 | " | " | 600 | " | " | 5.0 (4.5) | 3.0 | −0.23 |
| 15 | " | " | 600 | " | 2'30" | 5.8 (5.6) | 2.0 | −0.32 |
| 16 | " | " | 150 | " | " | 5.8 (5.6) | 2.5 | −0.35 |
| 17 | 102 | 16.5 | 150 | " | " | 5.8 (5.6) | 1.9 | −0.34 |

As is apparent from the results in Table 3, the effect of the present invention becomes particularly remarkable when the dry thickness of the photographic constituent layers was 20 μm or less, particularly 18 μm or less.

EXAMPLE 3

An ammonia water and 0.2 mol/liter of imidazole were added to each of the fixing solutions which were tested in Example 1 to change the pH of the fixing solution used. The samples of Example 1 which were wedge-exposed were processed by the same manner as in Example 1 except that the fixing time was shortened to 75 seconds.

The amount of residual silver on the unexposed portions, and the decoloration of yellow dye when the samples were then allowed to stand at a temperature of 60° C. and a relative humidity of 80% over 2 weeks were measured by the same manner as in Example 1.

The results are shown in Table 4 below. The value in parenthesis indicates a value which was obtained when the fixing time was 75 seconds.

TABLE 4

| Test No. | pH of Fixing Solution | Residual Silver Amount on Unexposed Portion (g/cm²) | Yellow Dye Discoloration |
|---|---|---|---|
| 1 (Comparison) | 7.5 | 2.2 (8.6) | −0.15 (−0.25) |
| 2 (Comparison) | 7.5 | 7.0 (19.2) | −0.30 (−0.29) |
| 3 (Comparison) | 7.5 | 13.8 (35.0) | −0.33 (−0.39) |
| 4 (Invention) | 6.8 | 2.4 (6.5) | −0.16 (−0.18) |
| | 7.0 | 1.9 (2.4) | −0.13 (−0.13) |
| | 7.3 | 1.4 (1.8) | −0.10 (−0.11) |
| | 7.5 | 0.8 (1.1) | −0.08 (−0.09) |
| | 7.7 | 1.3 (1.8) | −0.11 (−0.11) |
| | 8.0 | 1.8 (2.7) | −0.14 (−0.14) |
| | 8.2 | 2.5 (2.8) | −0.19 (−0.22) |
| 5 (Invention) | 6.8 | 2.7 (8.7) | −0.17 (−0.20) |
| | 7.0 | 2.2 (2.9) | −0.14 (−0.14) |
| | 7.3 | 1.6 (2.3) | −0.11 (−0.11) |
| | 7.5 | 0.9 (1.6) | −0.09 (−0.10) |
| | 7.7 | 1.3 (2.0) | −0.12 (−0.12) |
| | 8.0 | 1.8 (3.0) | −0.15 (−0.14) |
| | 8.2 | 2.6 (3.3) | −0.19 (−0.23) |
| 6 (Invention) | 7.5 | 1.6 (3.2) | −0.12 (−0.14) |
| 7 (Invention) | 7.5 | 1.8 (3.3) | −0.12 (−0.13) |
| 8 (Invention) | 7.5 | 2.0 (4.0) | −0.13 (−0.13) |
| 9 (Invention) | 7.5 | 1.7 (2.9) | −0.11 (−0.13) |
| 10 (Invention) | 7.5 | 1.8 (3.5) | −0.14 (−0.15) |
| 11 (Invention) | 7.5 | 2.3 (4.1) | −0.14 (−0.16) |

As is apparent from the results of Table 4, the excellent effect of the present invention can be obtained by controlling the pH of the fixing solution to from 7.0 to 8.0, and further when the fixing time is shortened, the particularly excellent effect can be obtained.

EXAMPLE 4

A color light-sensitive material Sample 107 as described in Example 1 of U.S. Pat. No. 4,842,994 was imagewise exposed. The dry thickness of the photographic constituent layer of Sample 107 was 17.9 μm.

The same procedure as in Example 1 of U.S. Pat. No. 4,842,994 was repeated except that the fixing time of Processing Step (I) of Example 1 in U.S. Pat. No. 4,842,994 is 2'00".

The used processing solutions (i.e., a color developing solution, a bleaching solution, a fixing solution and a stabilizing solution) were used for processing the light-sensitive material until the cumulated replenishment rate of the color developing solution reached twice volume of the color developing tank.

The sample which was wedgewise exposed at the color temperature of 4,800° K. and 20 CMS was processed at the conclusion of the running of the processing solution.

In the sample, the amount of residual silver on the unexposed portion was measured by a fluorescent X-ray process and the yellow discoloration was evaluated by the same manner as in Example 1 of the present specification.

With respect to the bleaching solution, the pH of the fresh tank solution and replenisher were changed and further the organic acid was added, as shown in Table 5 below. Then, the light-sensitive material was processed with the above processing solution.

The oxidation reduction potential of iron(III) ammonium ethylenediaminetetraacetate (EDTA-Fe) and iron-(III) ammonium 1,3-diaminopropanetetraacetate (PDTA-Fe) used in the bleaching solution was 110 mV and 250 mV, respectively.

TABLE 5

| Test No. | Color Developer Replenishment Rate (per m² of light-sensitive material) (ml) | pH of Replenisher | pH of Fresh Tank Solution | Organic Acid Added (pKa) | Amount of Organic Acid Added (mol) | Residual Silver Amount on Unexposed Portion | Yellow Discoloration |
|---|---|---|---|---|---|---|---|
| 1 | 429* | 5.8 | 6.0 | — | — | 7.6 | −0.29 |
| 2 | " | 5.0 | 5.5 | — | — | 7.3 | −0.26 |
| 3 | " | 4.5 | 5.0 | — | — | 6.9 | −0.25 |
| 4 | " | 3.5 | 4.0 | — | — | 6.7 | −0.23 |
| 5 | " | 4.5 | 5.0 | Acetic Acid (4.6) | 1.5 | 2.1 | −0.12 |
| 6 | " | 3.5 | 4.0 | Glycolic Acid (3.6) | 1.5 | 2.7 | −0.13 |
| 7 | " | 3.5 | 4.0 | Lactic Acid | 1.5 | 3.3 | −0.15 |

TABLE 5-continued

| Test No. | Color Developer Replenishment Rate (per $m^2$ of light-sensitive material) (ml) | pH of Replenisher | pH of Fresh Tank Solution | Organic Acid Added (pKa) | Amount of Organic Acid Added (mol) | Residual Silver Amount on Unexposed Portion | Yellow Discoloration |
|---|---|---|---|---|---|---|---|
| | | | | (3.7) | | | |

*The color developer replenishment rate of 429 ml/$m^2$ corresponds to that of 15 ml/$m^2$ of Processing Step (I) in Example 1 of U.S. Pat. No. 4,842,994.

As is apparent from the results of Table 5, the residual silver amount on unexposed portion and yellow discoloration were improved by adding organic acid according to the present invention.

In accordance with the present process, even if the replenishment rate of the color developing solution is reduced to 600 ml or less per $m^2$ of light-sensitive material in the processing of a silver halide color photographic material for photographing, excellent images can be obtained which are not susceptible to delay in fixing and discoloration in yellow dye with time.

While the invention has been described in detail and with reference to specific embodiments thereof, it will be apparent to one skilled in the art that various changes and modifications can be made therein without departing from the spirit and scope thereof.

What is claimed is:

1. A method for processing an imagewise exposed silver halide color photographic material for photography which comprises the steps of:

color-developing a silver halide color photographic material which comprises a photographic emulsion layer containing a silver bromoiodide, a silver chloroiodide or silver bromochloroiodide having an iodide content of from 0.1 to 30 mol%, with a color developing solution, processing said developed silver halide color photographic material with a bleaching solution, and then processing said bleached silver halide color photographic material with a processing solution having a fixing ability, wherein the replenishment rate of said color developing solution is 600 ml or less per $m^2$ of the photographic material; said bleaching solution contains a bleaching agent having an oxidation reduction potential of 150 mV or more and further an organic acid having a pKa of from 2 to 5.0, provided that an aminopolycarboxylic acid or a salt thereof and an iron complex salt of the aminopolycarboxylic acid are excluded, in an amount of 1.2 mol or more per liter of the bleaching solution; said bleaching solution has a pH value of 3.0 to 5.0; and the total time for processing said photographic material with the processing solution having a fixing ability is in the range of 30 seconds to 2 minutes.

2. The method for processing an imagewise exposed silver halide color photographic material for photography as claimed in claim 1, wherein the dry thickness of the constituent layers in said silver halide color photographic material is in the range of from 12 to 20 μm.

3. The method for processing an imagewise exposed silver halide color photographic material for photography as claimed in claim 1, wherein said bleaching agent is an inorganic compound selected from the group consisting of red prussiate of potash, ferric chloride, ferric bichromate, ferric persulfate and ferric bromate or an organic compound selected from the group consisting of ferric complex of aminopolycarboxylate.

4. The method for processing an imagewise exposed silver halide color photographic material for photography as claimed in claim 1, wherein said bleaching agent has an oxidation reduction potential of 180 mV or 5. The method for processing an imagewise expose silver halide color photographic material for photography as claimed in claim 1, wherein said bleaching agent is a ferric complex of 1,3-diaminopropanetetraacetic acid.

6. The method for processing an imagewise exposed silver halide color photographic material for photography as claimed in claim 1, wherein said replenishment rate of said color developing solution is from 100 to 500 ml.

7. The method for processing an imagewise exposed silver halide color photographic material for photography as claimed in claim 1, wherein said color developing solution and a replenisher of said color developing solution contain at least one of compounds represented by formulae (II) and (III):

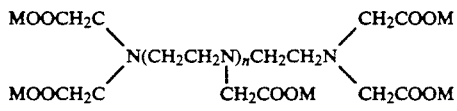

(II)

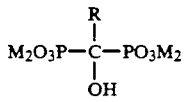

(III)

wherein n represents an integer 1 or 2; R represents a lower alkyl group; and M represents a hydrogen atom, an alkali metal atom or ammonium; the M's may be the same or different.

8. The method for processing an imagewise exposed silver halide color photographic material for photography as claimed in claim 1, wherein said bleaching solution has a pH of from 3.0 to 4.5.

9. The method for processing an imagewise exposed silver halide color photographic material for photography as claimed in claim 1, wherein said bleaching solution contains said bleaching agent in an amount of 0.10 mol or more per liter of the bleaching solution.

10. The method for processing an imagewise exposed silver halide color photographic material for photography as claimed in claim 1, wherein said bleaching agent has an oxidation reduction potential of from 230 to 280 mV.

11. The method for processing an imagewise exposed silver halide color photographic material for photography as claimed in claim 1, wherein said processing solution having a fixing ability is a fixing solution having a pH of 7.0 to 8.0.

12. The method for processing an imagewise exposed silver halide color photographic material for photography as claimed in claim 1, wherein said dry thickness of the constituent layers is from 12 to 18 μm.

13. The method for processing an imagewise exposed silver halide color photographic material for photography as claimed in claim 1, wherein said silver halide color photographic material comprises a photographic emulsion layer containing silver bromoiodide having a silver iodide content of from about 2 mol% to about 25 mol%.

* * * * *